US007027910B1

(12) United States Patent
Javaherian et al.

(10) Patent No.: US 7,027,910 B1
(45) Date of Patent: Apr. 11, 2006

(54) INDIVIDUAL CYLINDER CONTROLLER FOR FOUR-CYLINDER ENGINE

(75) Inventors: Hossein Javaherian, Rochester Hills, MI (US); Alan W. Brown, Canton, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 11/035,390

(22) Filed: Jan. 13, 2005

(51) Int. Cl.
*F02D 41/00* (2006.01)

(52) U.S. Cl. ..... 701/111; 123/673; 123/406.24

(58) Field of Classification Search ..... 701/111, 701/109, 102, 115; 123/673, 406.2, 406.24, 123/436
See application file for complete search history.

(56) References Cited

U.S. PATENT DOCUMENTS 6,024,070 A * 2/2000 May et al. ..... 123/406.25
6,314,952 B1 * 11/2001 Turin et al. ..... 701/109
6,668,812 B1 12/2003 Javaherian

FOREIGN PATENT DOCUMENTS

DE 38 02 803 A1 * 8/1988

* cited by examiner

*Primary Examiner*—Hieu T. Vo
(74) *Attorney, Agent, or Firm*—Kathryn A. Marra

(57) ABSTRACT

A generic technique for the detection of air-fuel ratio (or torque) imbalances in a 4-cylinder engine equipped with either a production oxygen sensor or a wide-range A/F sensor (or a crankshaft torque sensor) is developed. The method is based on a novel frequency-domain characterization of pattern of imbalances and its geometric decomposition into four basic templates. Once the contribution of each basic template to the overall imbalances is computed, templates of opposite direction are imposed to restore air-fuel ratio (or torque) balance among cylinders. At any desired operating condition, elimination of imbalances is achieved within few engine cycles. The method is applicable to current and future engine technologies with variable valve actuation, fuel injectors and/or individual spark control.

22 Claims, 13 Drawing Sheets

Pure Templates: $\begin{cases} T_1=[+1, +1,+1,+1],\ T_2=[-1,+1,-1,+1] \\ T_3=[+1, 0,-1,0],\ T_4=[0,+1,0,-1] \end{cases}$

Generic Imbalances: $V=[b_1.T_1+b_2.T_2+b_3.T_3+b_4.T_4]$

Pure Templates: $T_1=[+1, +1,+1,+1]$, $T_2=[-1,+1,-1,+1]$; $T_3=[+1, 0,-1,0]$, $T_4=[0,+1,0,-1]$

Generic Imbalances: $V=[b_1.T_1+b_2.T_2+b_3.T_3+b_4.T_4]$

INDIVIDUAL CYLINDER CONTROLLER FOR FOUR-CYLINDER ENGINE

TECHNICAL FIELD

This invention pertains to a method of detecting and correcting air-fuel ratio or torque imbalances in individual cylinders of a four-cylinder engine or banks of four cylinders in a V8 engine using a single sensor. More specifically, this invention pertains to the use of a frequency-domain characterization of the pattern of such imbalances in detecting and correcting them.

BACKGROUND OF THE INVENTION

There is a continuing need for further refinement of air-fuel ratio (A/F) control in vehicular internal combustion engines. At present, A/F is managed by a powertrain control module (PCM) onboard the vehicle. The PCM is suitably programmed to operate in response to driver-initiated throttle and transmission gear lever position inputs and many sensors that supply important powertrain operating parameters. The PCM comprises a digital computer with appropriate processing memory and input-output devices and the like to manage engine fueling and ignition operations, automatic transmission shift operations and other vehicle functions. In the case of such engine operations, the computer receives signals from a number of sensors such as a crankshaft position sensor, and an exhaust oxygen sensor.

Under warmed-up engine operating conditions, the PCM works in a closed loop continuous feedback mode using the voltage signals from an oxygen sensor related to the oxygen content of the exhaust. The crankshaft angular position information from the crankshaft sensor and inputs from other sensors are used to manage timing and duration of fuel injector duty cycles. Zirconia-based, solid electrolyte oxygen sensors have been used for many years with PCMs for closed loop computer control of fuel injectors in applying gasoline to the cylinders of the engine in amounts near stoichiometric A/F. The PCM is programmed for engine operation near the stoichiometric A/F for the best performance of the three-way catalytic converter.

With more strict emission standards gradually phasing in, there is a need for further refinement of automotive technologies for emissions reduction. One such refinement is the use of a linear response (wide-range) A/F sensor in the exhaust pipe(s) in place of the current zirconia switching (nonlinear) oxygen sensor. Experiments have demonstrated that significant reductions in tailpipe $NO_x$ emissions are possible because of the more precise A/F control offered by a linear A/F sensor.

A second refinement is to increase vehicle fuel economy by diluting the air-fuel mixture with excess air (lean burn) or with exhaust gas recirculation (external EGR). The maximum benefit is achieved at the highest dilute limit. However, in a multi-cylinder engine, the limit is constrained by the occurrence of partial burns and possibility of misfire in the cylinder(s) containing the leanest mixture. This happens due to maldistribution of air, fuel or EGR in different cylinders. Thus, a new capability for the control of each individual cylinder air-fuel ratio by software is needed. Here, the intention would be to control only one variable (e.g., air, fuel or spark) to create uniform A/F or torque in all cylinders since only a single variable (e.g., A/F, $O_2$ or torque) would be measured. Clearly, single-loop feedback controllers around various sensors can operate independently to control air, fuel or spark in every cylinder.

Another motivation for all-cylinder A/F control is cost containment. For very low emission applications, fuel injectors of high precision (i.e., very small tolerances of less than 3%) are thought to be required. Achievement of this degree of tolerance, if possible at all, would be costly. A better solution would be to have software means to compensate for the differences between fuel injectors in real-time operation of the engine. Another source of cylinder imbalances in a multi-cylinder engine is the inherent engine maldistribution due to variable breathing capacities into various cylinders. The air maldistribution can result in A/F or torque imbalances for which a software solution is sought.

A new emission reduction strategy was developed for detecting and correcting fuel, air or spark imbalances between cylinders of a three-cylinder gasoline engine. That process is disclosed in U.S. Pat. No. 6,668,812, titled "Individual Cylinder Controller for Three-Cylinder Engine" and assigned to the assignee of this invention. This process for a three-cylinder engine has to be modified and expanded for a four-cylinder engine and an individual cylinder control strategy now needs to be developed for a four-cylinder gasoline engine.

SUMMARY OF THE INVENTION

In this invention, a process is provided that would correct any imbalance in air or fuel delivery amongst all cylinders of a four-cylinder engine or separately in either bank of a V8 engine. Such imbalances are detectable using, for example, an oxygen sensor, a wide range air-fuel ratio (A/F) sensor, or an engine torque sensor. The benefits in terms of emissions reduction, fuel economy and drivability will depend on the degree of A/F imbalances or torque imbalances present in the engine and are engine dependent. In general, it is estimated that the benefit would depend on exhaust system configuration as well. For example, the benefit in a V8 engine with dual banks of unequal pipe lengths is larger when a single sensor is used for control and when fuel injectors have larger tolerances.

A principal cause, but not necessarily the sole cause, of cylinder A/F imbalances in a fuel-injected engine is differences in the delivery rates of the fuel injectors. Fuel injectors are intricate, precision-made devices, but the delivery rates of "identical" injectors may vary by as much as ±5%. Thus, the normal operation of a set of such injectors may be expected to lead to the delivery of varying amounts of fuel in the respective cylinders even when the PCM specifies identical "injector on" times. If the air flow rate or the exhaust gas recirculation rate is not varying in proportion with the fuel imbalances, there can be significant differences in A/F and/or torque among cylinders.

In a four-cylinder (or dual exhaust system V8) engine, individual cylinder maldistributions of air, fuel and EGR cause fluctuations in the instantaneous oxygen sensor voltages measured downstream at the point of confluence in the exhaust manifold. These $O_2$ sensor voltages are representative of the A/F of the cylinders. The actual A/F signal is periodic with the successive exhausts of the four cylinders, but the periodic pattern remains similar over prolonged engine operation especially if the pattern is due mainly to variances in fuel injector deliveries. Any arbitrary pattern of cylinder to cylinder differences in A/F ratio can be represented by a combination of simpler basic A/F patterns here referred to as "templates". In this notation, a template consists of a unique pattern of −1, 0 and +1 units of A/F (or torque), or a multiple thereof, in each cylinder. In the context of cylinder A/F control, negative and positive signs imply fuel-rich and fuel-lean A/F, respectively, and 0 implies stoichiometric A/F for a particular cylinder exhaust event. At this point, the values of −1 and +1 simply indicate rich and lean A/F without regard to the magnitude of the departure of the ratio from the stoichiometric value, typically about 14.7 for most common gasoline fuels available today.

Obviously, each cylinder could experience a rich or lean A/F when the PCM is trying to control the overall A/F at the stoichiometric ratio. However, it has been determined in connection with this invention that the patterns of all possibilities are not independent of each other. It turns out that the number of independent basic patterns in this representation is equal to the number of cylinders. Specifically for a four-cylinder engine, any unknown pattern of imbalances can be reduced to a unique combination of four patterns $T_1$, $T_2$, $T_3$ and $T_4$ as shown in FIG. 1. Referring to FIG. 1, template $T_1$ is the pattern ++1, +1, +1, +1 (for example, rich A/F) for cylinders 1, 2, 3, 4 respectively. Template $T_2$ is the pattern −1, +1, −1, +1 (e.g., alternating rich and lean A/F) for cylinders 1, 2, 3, 4 respectively. Template $T_3$ is the pattern +1, 0, −1, 0. And Template 4 has the pattern 0, +1, 0, −1.

It has been further discovered in connection with this invention that the pattern of unknown four-cylinder A/F (or torque) imbalances with magnitudes ($a_1$, $a_2$, $a_3$ and $a_4$) can be uniquely related to the above four templates by appropriate weighting factors ($b_1$, $b_2$, $b_3$, $b_4$) applied to the values of the terms of each template (FIG. 1). Thus, the knowledge of the set of coefficients ($b_1$, $b_2$, $b_3$, $b_4$) is equivalent to knowledge of the unknown values of the imbalances ($a_1$, $a_2$, $a_3$ and $a_4$) in the engine's four cylinders. Thus, an imbalance (V) in, for example, air-fuel ratio (A/F) or in torque can be determined as follows:

$$V=b_1T_1+b_2T_2+b_3T_3+b_4T_4$$

The coefficients may have positive or negative values or the value of zero. For each template $T_i$, the coefficient $b_i$, is a constant determined by the magnitude of the measured imbalances. Often it is preferred that the coefficients have values expressed as percentages of the cylinder weighting factors of the templates.

Each template of cylinder imbalances yields a discrete frequency spectrum of output data (e.g., oxygen sensor data or torque sensor data) with non-zero magnitudes only at a finite number of frequencies. In the case of four cylinders, certain frequency spectrum characteristics are found and can be utilized in control of individual cylinders in accordance with this invention. For templates $T_3$ and $T_4$, the frequency spectrum has only two lines. The first line is at a fundamental frequency $\omega_1$ corresponding to the engine speed. The second line is at twice the fundamental frequency. For $T_3$ and $T_4$, the non-zero magnitudes (at $\omega_1$ and $2\omega_1$) are coupled so that they increase or decrease together. $T_3$ and $T_4$ are templates characterized by a sequence of +1, 0, −1 cylinder values. This coupling at the first harmonic is used in the subject method of correction of cylinder imbalances. For template $T_2$ (characterized by alternating minus and plus values with no intermittent zero values), the spectrum has a single line at twice the fundamental frequency and this second harmonic spectrum is used in this method of correcting cylinder fuel or air imbalances.

It also turns out that the pattern of $T_1$, identically rich or lean in all cylinders, is corrected in the PCM by the current closed-loop control using $O_2$ sensor. Alternatively, any excess torque level measured by a torque sensor is corrected by positioning of a variable valve actuator in the intake valves in a multi-cylinder engine using a feedback control loop. Therefore, this template does not need to be used in detecting imbalances $a_1$, $a_2$, $a_3$ and $a_4$. As will be shown, the total imbalances under closed loop A/F control can be detected by appropriate mathematical comparison with data compiled from experimentally predetermined values for patterns $T_2$, $T_3$, and $T_4$.

Reference values for template patterns $T_2$, $T_3$ and $T_4$ are established on a balanced four-cylinder engine (i.e., all cylinders initially at stoichiometric A/F, any other specified A/F or torque reference level) by operating the engine with calibrated fuel injectors (or intake valves) to intentionally successively impose the three template cylinder variation patterns at the desired fuel-rich or fuel-lean levels (or air flow rates, respectively). This calibration process is conducted at selected representative operational speeds and loads for the engine over a sufficient number of engine cycles to obtain the corresponding $O_2$ sensor (wide range A/F sensor or torque sensor) output at successive crankshaft positions. In other embodiments of the invention, a wide-range A/F sensor or a torque sensor is used. For example, at each engine speed and load, pattern $T_3$ could be produced by a lean imbalance of +10% of stoichiometric A/F in cylinder #1, a rich imbalance of −10% of the stoichiometric A/F in cylinder #3 while cylinders #2 and #4 are operated at the stoichiometric A/F. Then, imbalances of like magnitude could be imposed in accordance with the $T_2$ and $T_4$ patterns. For example, assuming 24× available crankshaft position signals over one crankshaft revolution, oxygen sensor data would be collected by the PCM every 15° of crankshaft revolution. In a V8 engine, we will have six samples collected per event. If desired, we may obtain one averaged sample per engine event.

The calibration data from $O_2$ (or wide-range A/F or crankshaft torque) sensor for each template $T_2$, $T_3$ and $T_4$, at desired representative engine speeds (rpm) and loads (represented by manifold absolute pressure, MAP, or manifold air flow, MAF), is subjected to the discrete Fourier transform (DFT) to determine its frequency spectrum. The discrete spectrum is represented by a vector of given phase angle and magnitude information at various frequencies related to the base engine speed and its higher harmonics. This information, together with interpolated data or suitable analytical equations, is stored in PCM table lookups for reference by the PCM during the cylinder air or fuel imbalance detection in a vehicle. In the case of a bank of four cylinders, the DFT vectors for the chosen templates, $T_2$, $T_3$ and $T_4$, are mutually orthogonal by construction.

Having established reference data for the transformed templates, fuel or air imbalances in the operating engine can then be detected and corrected as necessary. To the extent that cylinder to cylinder imbalances in fuel injection or air intake are due to injector or intake valve delivery variations, it is expected that such imbalances will follow a regular pattern, and once detected, an appropriate correction may remain effective until further usage of the injectors or intake valves will have changed the level of imbalances. Accordingly, the detection and correction parts of this invention may not have to be run continually. However, as will be seen, they can also be run as frequently as required by the PCM due to speed of convergence and computational efficiency.

The detection process is initiated by the PCM and includes collecting and storing oxygen sensor (or wide range A/F or torque sensor) data at successive crank angle signals over a few engine cycles. One complete fueling cycle providing, for example, 48 data points may be suitable. But it will usually be preferred to collect data over several cycles. This data is subjected to discrete Fourier transformation to obtain the phase and magnitude representing a single vector of imbalances.

The detected air or fuel imbalance vector is mathematically decomposed to determine the respective contributions of the three mutually orthogonal reference vectors, $T_2$, $T_3$ and $T_4$, in the total vector of measured imbalances. In other words, the coordinates of the imbalance vector in terms of the phase angles of the reference vectors and the proportion of their respective magnitudes are determined by known mathematical practices. The conversion of the imbalance vector into three component vectors permits the correction for the fueling imbalances by the PCM. The PCM determines the "opposite" of the three components of imbalances vectors, i.e., vectors that have the same magnitude but are of 180° phase difference, and calculates the air or fueling corrections that must thereafter be applied to each fuel injector (or intake valve lift) to correct the imbalances otherwise present in the respective cylinders. These fuel injector or intake valve lift corrections are applied cycle after cycle until the detected level of imbalances is brought below a given threshold.

As stated, the subject process may be used in response to the signals from a current production exhaust oxygen sensor, a wide-range exhaust A/F sensor, a crankshaft torque sensor or other suitable sensors used by a PCM for fuel, air or spark control in a four-cylinder engine. As is known, fuel control to individual cylinders can be accomplished by PCM control of fuel injector "on time". Similarly, air distribution to the four cylinder banks can be managed by PCM control of air inlet valve actuators. And, in accordance with this invention, detected imbalances in torque from individual cylinders can be corrected by PCM control of fuel or air delivery or spark timing with respect to each cylinder.

In the above-described reference templates, stoichiometric A/F, generally about 14.7 for current commercial gasoline, was used as the mean A/F value because of the wide practice of operating engines at about stoichiometric A/F for best operation of current exhaust catalytic converters. However, if it is desired to operate the engine fuel rich, e.g., A/F=about 10 to 14.7, the mean value for the templates would be a selected value in this range. Similarly, where it is desired to operate in a fuel lean mode, e.g., A/F=about 14.7 to 60, a mean template value in the lean range would be used.

Other objects and advantages of the invention will become apparent from a description of embodiments of the invention which follow.

DESCRIPTION OF THE PREFERRED EMBODIMENT

A strong motivation for detection and correction of individual cylinder fuel imbalances is for cost-effective improvement of fuel economy, driveability and reduction of exhaust emissions. Fueling imbalances can possibly be reduced by using fuel injectors of high precision, i.e., specifying injectors with fuel delivery tolerances of less than three percent. Achievement of this high degree of manufacturing precision, if possible, would be costly. In this invention, a method is provided to address this problem in four-cylinder engine banks exhausting to a common exhaust duct by utilization of an existing onboard microprocessor.

As stated in the Summary of Invention section of this specification, any arbitrary pattern of cylinder-to-cylinder differences in A/F ratio can be represented by a combination of simpler basic A/F patterns here referred to as "templates". In this notion, a template consists of a unique pattern of −1, 0 and +1 units of A/F in each cylinder only. The value zero denotes stoichiometric mass air-fuel ratio (A/F), and negative and positive signs imply fuel-rich and fuel-lean A/F, respectively. In the case of lean burn engine operation the value zero may denote a specified relatively high A/F, and then negative and positive signs imply fuel-richer and fuel-leaner A/F, respectively.

Figure 1:
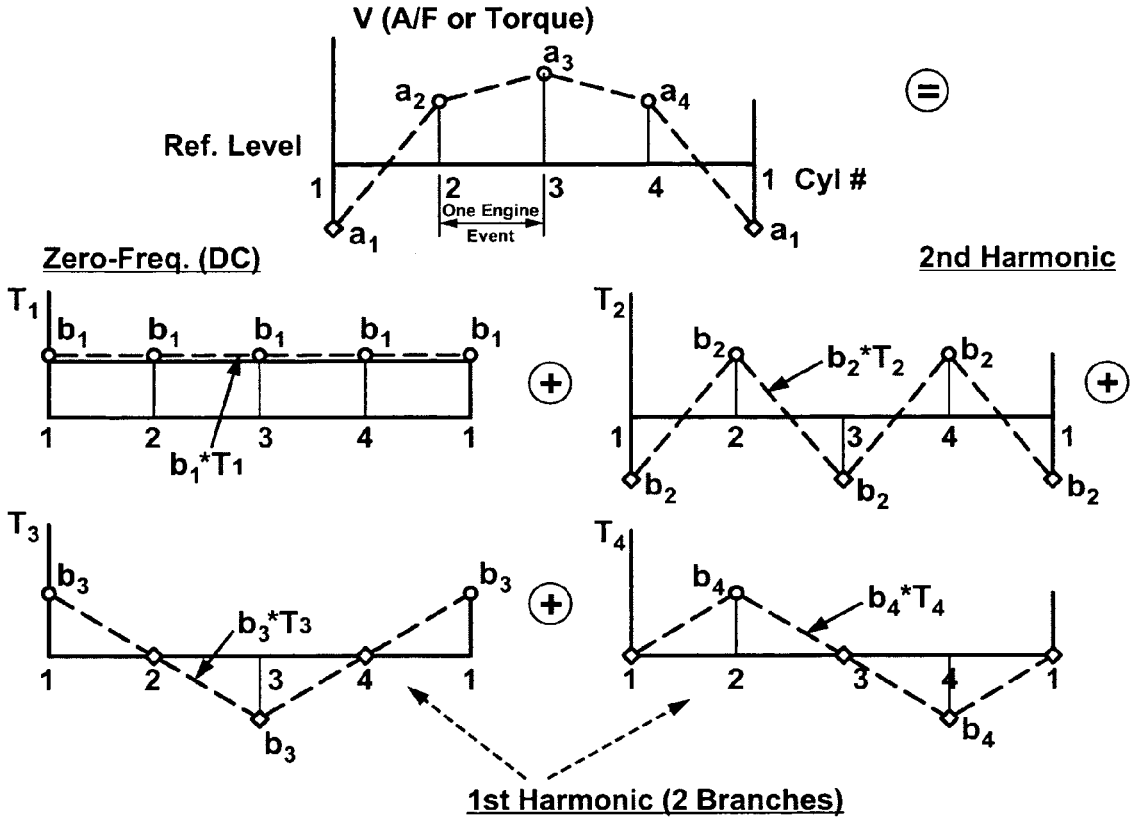
FIG. 1 is a graphical representation of four reference fueling imbalance templates, labeled $T_{1\ to\ T4}$, used in the practice of this invention for a four-cylinder engine. The horizontal axis represents cylinder number, the upward arrows represent fuel lean A/F and the downward arrows represent fuel rich A/F for the respective cylinders around the reference value of stoichiometry (or other selected A/F). Also shown in FIG. 1 is an example of an unknown fuel imbalance template with equations showing the contributing relationships of the reference templates to the unknown imbalance template.

For a four-cylinder engine, any unknown pattern of imbalances can be reduced to a combination of four basic patterns $T_1$, $T_2$, $T_3$ and $T_4$ shown in FIG. 1. As seen in FIG. 1, Template 1 has the pattern +1, +1, +1, +1 for cylinders 1, 2, 3 and 4, respectively. This pattern represents a complete fueling cycle for cylinders 1–4, respectively, of the engine although the actual fueling sequence may be in the order of cylinder 1, 3, 4, 2. Template 2 is the pattern −1, +1, −1, +1 for cylinders 1, 2, 3 and 4; Template 3 represents the pattern +1, 0, −1, 0 and Template 4 represents the pattern 0, +1, 0, −1.

In the development of this invention, it has been rigorously demonstrated that these four templates provide a basis for detecting any pattern of fueling imbalances in a four-cylinder engine bank. A similar argument applies to torque imbalances amongst cylinders due to individual intake valve differences. Referring to FIG. 1, the top template illustrates a four-cylinder engine operating situation of unknown A/F imbalances ($a_1$, $a_2$, $a_3$ and $a_4$) for cylinders 1, 2, 3 and 4, respectively). Any pattern of such unknown cylinder imbalances (whether A/F imbalances, torque imbalances or spark timing imbalances) can be uniquely related to the above four templates by appropriate weighting factors ($b_1$, $b_2$, $b_3$, $b_4$) applied respectively to the values of the terms of each template $T_1$, $T_2$, $T_3$ and $T_4$. FIG. 1 shows the applicable equations relating fueling imbalances $a_1$, $a_2$, $a_3$ and $a_4$ to their cylinder counterparts in the four reference templates. Thus, the knowledge of the sets of coefficients ($b_1$, $b_2$, $b_3$, $b_4$) is equivalent to knowledge of the unknown values of the imbalances ($a_1$, $a_2$, $a_3$ and $a_4$) in the engine's four cylinders. The coefficients ($b_1$, $b_2$, $b_3$, $b_4$) may have positive or negative values or the value of zero. Often it is preferred that the coefficients have values expressed as percentages of the cylinder weighting factors of the templates.

A close examination of cylinder imbalance templates reveals the following properties. Each template has a discrete frequency spectrum with non-zero magnitudes only at a finite number of frequencies. For templates $T_3$ and $T_4$, the spectrum has two lines only. The first line is at a fundamental frequency $\omega_1$ corresponding to the engine speed. The second frequency is twice the fundamental frequency. Template $T_1$ indicates a uniform A/F across all cylinders and its spectrum has non-zero value only at $\omega=0$. This static component (with weighting factor $b_1$) is usually eliminated by the closed-loop average A/F controller and can be discarded. Therefore, there remain only three unknown template factors $b_2$, $b_3$ and $b_4$.

For $T_3$ and $T_4$, the non-zero magnitudes (at $\omega_1$ and $2\omega_1$) are coupled so that any changes at one frequency will impact the other one, i.e., they increase or decrease together. This implies that one can focus on the contributions at the fundamental frequency $\omega_1$ only. This observation is important as it reduces the sensor bandwidth requirement for imbalances detection and correction. Elimination of imbalances at the fundamental frequency for each template $T_3$ and $T_4$ results in a perfectly balanced A/F with respect to these components in all cylinders.

For Template $T_2$, the spectrum has a single line at twice the fundamental frequency.

In the presence of A/F imbalances, a Fourier series analysis of the A/F signal indicates that the frequency spectrum of the A/F signal consists of multiple (infinite) harmonics but the spectrum is dominated by the first and second harmonics. The first (or fundamental) harmonic $\omega_1$ depends on engine speed. Higher harmonics are integer multiples of the fundamental frequency $\omega_1$.

Figure 9:
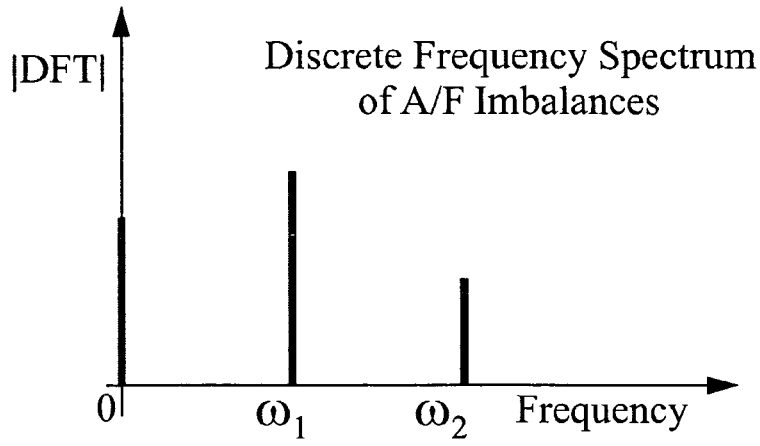
FIG. 9 is a graph illustrating an example of a discrete Fourier transform of A/F imbalances in a four-cylinder engine having spectral lines only at the frequency $\omega_1$ corresponding to the base engine speed and its higher harmonic $\omega_2=2\omega_1$ in addition to the static value at $\omega=0$.

Any single linearly independent pattern of imbalances chosen from the set [−1, 0, +1] will constitute a possible solution, though incomplete, and will be referred to as a balancing template. In general, to cancel imbalances in a 4-cylinder engine, four templates are required so that a unique (and complete) solution is obtained. The frequency spectrum of each balancing template, in general, is composed of up to three frequencies. With the average A/F controlled by the main fuel controller in current production systems, the DC component of imbalances ($T_1$ in FIG. 1) will become irrelevant and may be excluded. This leaves us with only three balancing templates with non-zero discrete frequency spectrums consisting of two frequencies only. FIG. 9 is a graph illustrating an example of a discrete Fourier transform DFT of A/F signal (for example from a warmed up exhaust $O_2$ sensor) in a four cylinder engine.

In the practice of this invention, exhaust sensor or torque sensor signals are subjected to Fourier transforms. For a sensor signal x(n) sampled at discrete time intervals n=0, 1, . . . , N−1, the Fourier transform is defined by the following expression:

$$X(k) = \sum_{n=0}^{N-1} x(n) \cdot e^{-j2\pi kn/N}$$

Here, $j=\sqrt{-1}$ is the complex number, N=total number of data points and k=number of spectral lines in the Fourier transform. The resulting spectrum has non-zero values only at a discrete number of frequencies $\omega_k=2\pi kn/N$ and, hence, is called the Discrete Fourier Transform (DFT). The Discrete Fourier Transform maps N complex numbers x(n) into N complex numbers X(k). In this case, the samples from sensor signal x(n) have real parts only.

For computational efficiency, when the number of sensor data points is a power of 2 (i.e., $N=2^v$, v=a positive integer), then there are well-known efficient techniques to reduce the time and the complexity of DFT computations. The technique is called Fast Fourier Transform (FFT). In most practical DFT calculations, the number of samples is taken as powers of two (e.g., 16, 32, 64, 128, etc.), if possible, to expedite DFT calculations.

In an attempt to find out and eliminate the individual cylinder A/F imbalances, it is preferred to use a single exhaust sensor to measure A/F (or $O_2$ concentration or torque) signal after the point of confluence in the exhaust manifold. The sensor is sampled at a rate compatible with the recovery of the first harmonic and for a length of at least one full engine cycle. A fast or discrete Fourier transform (FFT or DFT) of the A/F signal is performed and the amplitude of the first harmonic is computed. Magnitudes larger than a given threshold at each mode indicate a significant imbalance at that mode.

Once the level of imbalances at the frequency of interest has been detected, the corrective templates are imposed individually and simultaneously to reduce the level of total imbalances to near zero. In other words, the control signal uses the logical templates corresponding to various modes and modal shapes (i.e. discrete modes). Because of the frequency-based and discrete (as opposed to other proposals which are time-based and continuous) nature of this method, this technique is referred to as Discrete Modal Control (DMC).

By shifting attention from the time-domain to the frequency-domain, the structure of the essential information latent in the A/F signal is revealed. In this method, there is no undue attention to signal details such as the high-frequency components or noise effects which are sensitive issues in many time-domain methods for the synthesis of imbalances. It is also important to note that no synchronization signal is being used which avoids the risks associated with possible synchronization errors or its potential loss. This will also relax the sensor dynamic bandwidth and sampling rate requirements. The method is still effective, up to very high precision, where the A/F signal may be non-periodic. All these factors point to a method with robustness as its main attribute. This technique is simple to understand and easy to implement and has led to a powerful technique for individual cylinder A/F or torque control.

The Technique

With an exhaust sensor of sufficiently wide dynamic-bandwidth, the sensor signal is sampled at a predetermined rate (preferably in tandem with engine events) and for a predetermined period of time (preferably a number of engine cycles) and processed according to the following sequence of three steps:

I. Determination of base templates spectrum phase angle and magnitude information. This constitutes the calibration step and is carried out a priori (offline) and stored as table lookups (or as analytic functions) for real-time individual cylinder fuel control.

II. Detection of imbalances (DFT or FFT analysis).

III. Correction of imbalances (discrete modal control or DMC)

Figure 2:
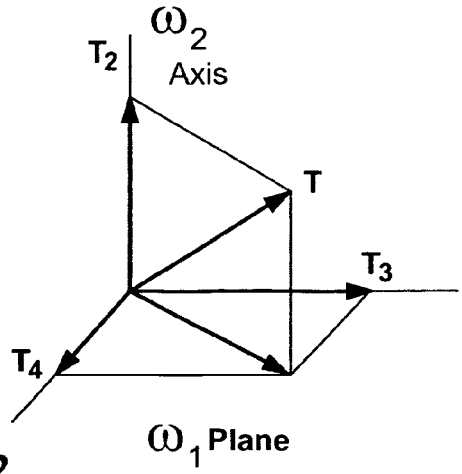
FIG. 2 illustrates the projections of an imbalance vector T onto its orthogonal components T2 (@ $\omega_2$, where $\omega_2$ is the $2^{nd}$ harmonic of engine speed), and $T_3$ and $T_4$ (both @ $\omega_1$, where $\omega_1$ is the $1^{st}$ harmonic). $T_3$ is perpendicular to $T_4$ in the $\omega_1$ plane and $T_2$ is on the $\omega_2$ axis and perpendicular to the plane formed by $T_3$ and $T_4$.

As will be illustrated in more detail below, the detection of an imbalance in A/F is represented as an imbalance vector T (FIG. 2). Imbalance vector T is mathematically resolved into contributions of the pure template vectors $T_2$, $T_3$ and $T_4$. Template vectors $T_2$, $T_3$ and $T_4$ are mutually orthogonal as seen in FIG. 2. $T_3$ and $T_4$ are determined at the first harmonic, $\omega_1$, and $T_2$ at the second harmonic, $\omega_2$. $T_3$ and $T_4$ lie in the $\omega_1$ plane and $T_2$ lies on the $\omega_2$ axis.

Unknown generic imbalances $a_1$, $a_2$, $a_3$, and $a_4$ from the four individual cylinders culminated in the imbalance vector T are eliminated by applying the opposite values $-a_1$, $-a_2$, $-a_3$, and $-a_4$ to the respective cylinders. The unknown values $a_1$, $a_2$, $a_3$, and $a_4$ are obtained from contributions to the cylinders, $b_1$, $b_2$, $b_3$, and $b_4$, associated with pure templates $T_1$, $T_2$, $T_3$, and $T_4$, respectively. Alternatively, each template contribution $b_1$, $b_2$, $b_3$, and $b_4$ is individually detected and corrected to create total balance. It is to be noted that techniques for removal of the first template $T_1$ (i.e. the DC component of imbalances) is well known to those in the current practice and, therefore, will not be elaborated further. Thus, the remaining templates contribute to the generic imbalances as follows.

| | |
|---|---|
| Generic Imbalances: | $a_1 = b_1 - b_2 + b_3$ |
| | $a_2 = b_1 + b_2 + b_4$ |
| | $a_3 = b_1 - b_2 - b_3$ |
| | $a_4 = b_1 + b_2 - b_4$ |

I. Calibration Step (Determination of the Spectrum of Basic Templates)

Any sequence of cylinder imbalances is first reduced to the minimal constituent modal shapes of 3 modes at (known) frequencies $\omega_1$ and $\omega_2$ but unknown amplitude. Thresholds for the admissible level of imbalances for each mode are also established.

This step constitutes the calibration phase where the individual templates of known nominal magnitudes $d_{30}$ and $d_{40}$ (say 10%, for templates $T_3$ and $T_4$, respectively) are directly imposed on a balanced engine first. The frequency spectrum of the resulting signal (A/F, $O_2$ or crankshaft torque sensor) in terms of its phase and magnitude information is determined at the given engine speed. This information is stored in table lookups for references during the detection phase.

Either a fast Fourier transform (FFT) or discrete Fourier transform (DFT) is used to fill the table lookups at different engine speeds and for various loads (MAP or MAF). This step is essentially a calibration requirement and is executed offline. If desired, data for various operating conditions can also be curve-fitted so that a simpler analytic function for the spectrum is derived.

Figure 3A:
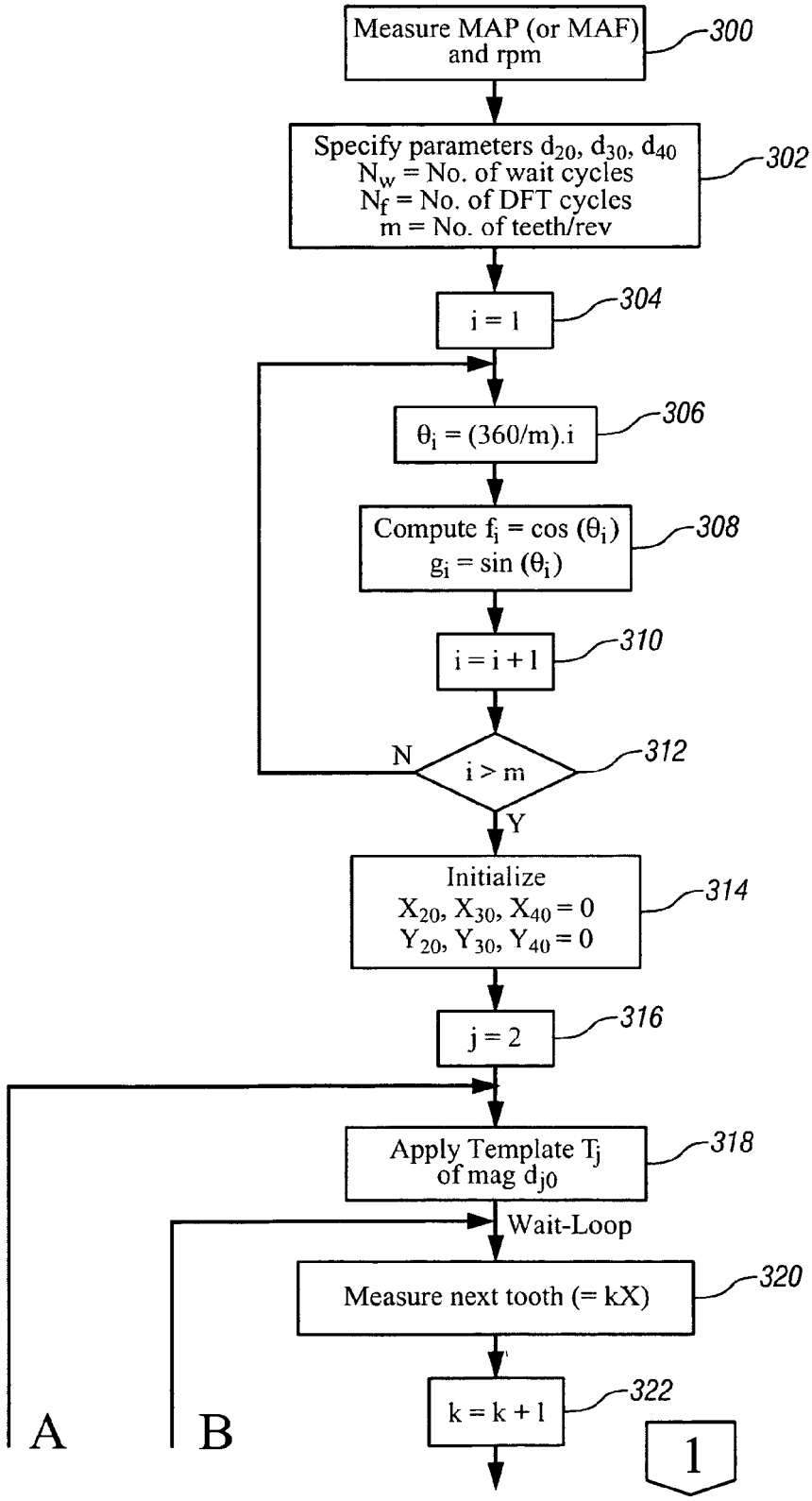
FIGS. 3A–3C are flow diagrams of a suitable algorithm for the offline computation of responses to pure $T_2$, $T_3$ and $T_4$ imbalances of magnitude $d_{20}$, $d_{30}$ and $d_{40}$ in a balanced four-cylinder engine.
Figure 3B:
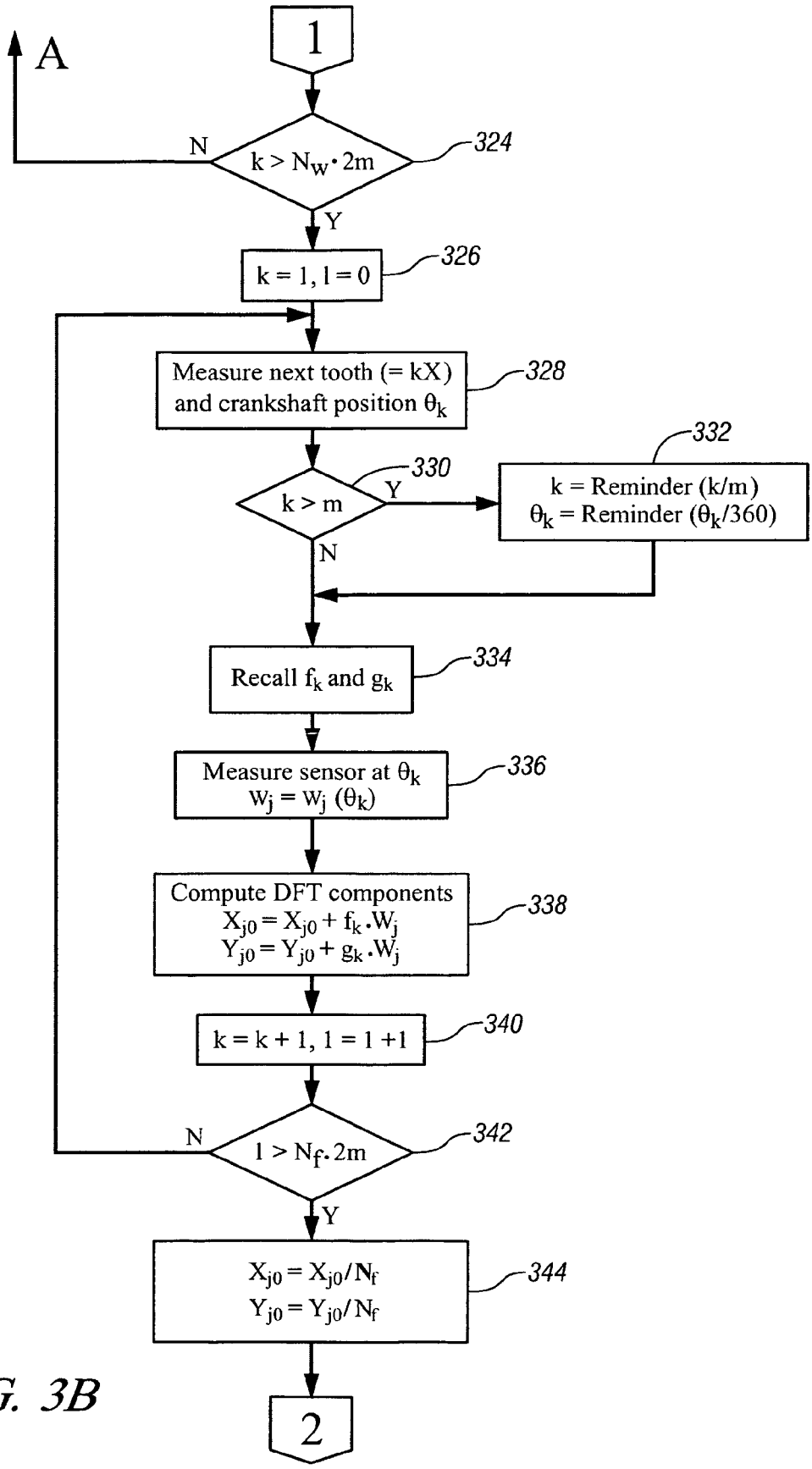
Figure 3C:
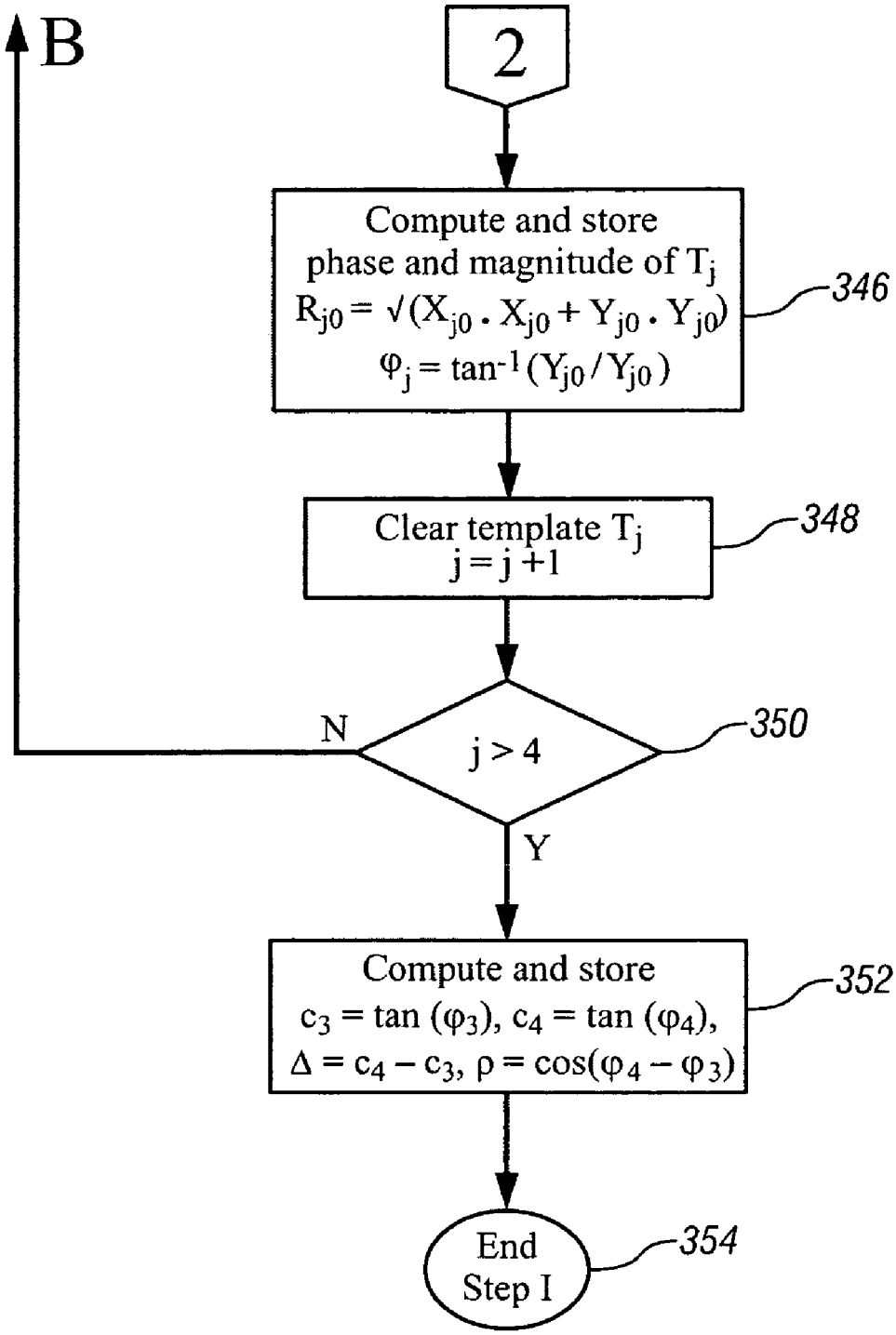

The procedure for the determination of the response of individual templates at any engine speed N and load [manifold absolute pressure (MAP) or mass air flow MAF)] is as follows. Reference will be made to FIGS. 3A–3C.

The selected or measured engine and MAP or MAF values together with engine speed (rpm) are stored in the PCM as indicated at block 300 of FIG. 3A. In block 302, a set of parameter values regarding the magnitude of templates $T_2$, $T_3$ and $T_4$ named $d_{20}$, $d_{30}$ and $d_{40}$, respectively, is stored. For example, an imbalance magnitude of 10% of the stoichiometric A/F may be used for each of $d_{20}$, $d_{30}$ and $d_{40}$. In block 302, the number of wait cycles $N_w$ and the number of signal cycles $N_F$ for execution of DFT computations together with the number of teeth per rotation of crankshaft (m) are recorded. Calculations begin by setting index i=1 in block 304. The process then proceeds as follows:

1. Choose two independent templates $T_3$ & $T_4$. These templates may be characterized by $$T_3=[+-1, 0, -1, 0], \text{ and}$$

$$T_4=[0, +1, 0, -1].$$

2. Use crankshaft mX signal available in an L4 engine or V8 engine (e.g., m=24) for DFT calculations. The resolution $\theta_r$ would then be 360°/m (i.e., 15° in V8). The A/F (or $O_2$) signal is successively sampled at $\theta_i=i.\theta_r$ where i=1, . . . ,m (e.g. m=60 for L4 or m=24 for V8) as indicated in block 306.

3. Compute $f_i=\cos(\theta_i)$ and $g_i=\sin(\theta_i)$ for all i=1, . . . , m. For any engine family, this calculation is done once and for all. Results are stored in table lookups for the imbalances detection step. This calculation at respective crankshaft positions is shown in block 308. In block 310, the crankshaft sensor index is incremented and operations return to block 306 until the answer to the query in box 312 is "yes," indicating that the calculations for all crankshaft positions are completed.

The values of $\sin(\theta_i)$ and $\cos(\theta_i)$ having been calculated for all crankshaft angle increments of $\theta_i$, the process now proceeds to determining the oxygen sensor outputs for the crankshaft angles of interest. Upon a positive response (yes) in box 312, the initial components of imbalances are set to zero as shown in box 314 and a template value j=2 or 3 or 4 is adopted for the current template, e.g., Template $T_{3\ 0}$=3) as indicated in process flow box 316.

4. Apply template $T_3$ imbalances of magnitude $d_{30}$ as shown in box 318 (j=3). To eliminate the effects of fuel transients, it is preferred to wait $N_w$ cycles before measuring the system response. The crankshaft angle is measured (block 320), monitored (block 322) and checked (block 324, FIG. 3B) to insure that the required number of wait cycles $N_w$ are elapsed before date collection. Once the required number of wait cycles are elapsed, calculations are transferred to block 326 where indexes associated with crank angle and total number of signal cycles for DFT calculations are initialized (blocks 328, 330, and 332).

The $f_k$ and $g_k$ values for current crankshaft angle k are retrieved from memory, block 334. And the oxygen sensor (or torque sensor) output $W_j(\theta_k)$ at the current crankshaft ankle $\theta_k$ is stored as $W_j$, block 336.

For the signal sampled at the rate of m samples/rev, compute the DFT($T_3$) with magnitude $R_{30}=|DFT(T_3)|$ and phase $\omega_3=\angle DFT(T_3)$ or, alternatively, the Cartesian components $X_{30}$ and $Y_{30}$. For example, in Cartesian coordinates, DFT values over one engine cycle are computed from:

$$X_{30}=\Sigma f_i * W_1(\theta_i),\ i=1, \ldots m$$

$$Y_{30}=\Sigma g_i * W_1(\theta_i),\ i=1, \ldots m$$

where $W_1(\theta_1)$ is the system response at crank angle $\theta_i$ due to the imposed template $T_3$, block 338. In blocks 328–342, the necessary cycle of steps to compute the DFT components of the imbalances are shown. The DFT components are calculated at the respective crank angles, until the calculation is completed over the specified number of cycles, block 342. When calculations for the required number of cycles $N_f$ (block 342) is completed, control is transferred to block 344 where the average components $X_{30}$ and $Y_{30}$ are determined. The values of $X_{30}$ and $Y_{30}$ are stored in table lookup data for the imbalances correction step. With the knowledge of these Cartesian components, the radial components $R_{30}$ and $\phi_j$ are also calculated as in block 346 (FIG. 3C).

5. Similarly, repeat step 4 for templates $T_2$ and $T_4$ with magnitudes $d_{20}$ and $d_{40}$. For $T_4$, increment index J to 4 as in block 348 and repeating all steps in blocks 318–346 (Loop B). Compute DFT($T_4$) with magnitude $R_{40}=|DFT(T_4)|$ and phase $\phi_4=\angle DFT(T_4)$ as in block 346, or, alternatively, the Cartesian components $X_{40}$ and $Y_{40}$ as in block 344. Store $X_{40}$ and $Y_{40}$ in table lookups for the imbalances correction step. Once all templates $T_2$, $T_3$ and $T_4$ have been applied (positive answer to query in block 350) and corresponding responses determined the process proceeds to block 352.

Figure 10:
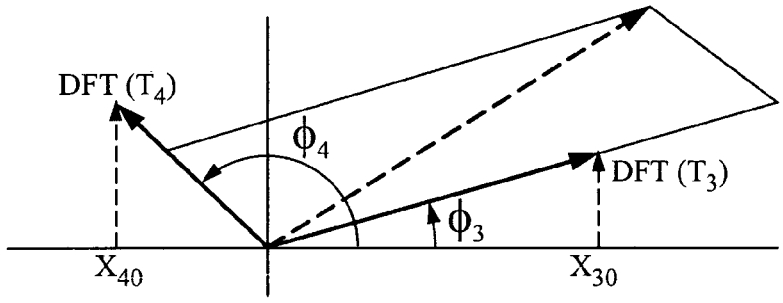
FIG. 10 is a graph illustrating an example of two possible discrete Fourier transform (DFT) vectors $T_3$ and $T_4$ with their respective magnitudes and phase angles $\phi_3$ and $\phi_4$.

FIG. 10 is a graph illustrating an example of two possible DFT ($T_3$) and DFT ($T_4$) vectors with their respective magnitudes and phase angles $\phi_3$ and $\phi_4$. In these templates for a four cylinder engine, the phase angles of the templates are generally 120° apart. Of course, the Cartesian coordinates of these vectors can be determined by projecting on the x and y axes.

6. Compute and store $\Delta=c_4-c_3$ where $c_3=\tan(\phi_3)$ and $c_4=\tan(\phi_4)$ as in block 352. This value is used in the correction phase of the algorithm.

7. Compute and store $\rho=\cos(\phi_4-\phi_3)$ as in block 352. This value is also used in the correction phase of the algorithm. The initial calibration data is now completely available (end block 354) for the imbalances detection and correction steps to follow.

For $O_2$ sensor-based calibration, due to the non-linearity of the sensor, the calibration has to be carried out at different levels of imposed A/F imbalances. Alternatively, one can approximate the non-linear calibration curves conservatively and then through iterative corrections (i.e., step III).

II. Detection of Imbalances

Full knowledge of the phase and magnitude of DFT associated with arbitrary unknown imbalances is a powerful tool for the detection and elimination of the imbalances. Any arbitrary pattern of A/F imbalances can be decomposed into two basic templates $T_3$ and $T_4$ (predominantly at frequency $\omega_1$), a third template $T_2$ (at frequency $2\omega_1$), plus a template $T_1$ constant DC component. The DC part is automatically eliminated by the average A/F controller.

Superposition of the tri-templates of appropriate magnitudes (yet unknown) would yield the total imbalances. In this approach, the spectrum of A/F. (or $O_2$ or torque) sensor signal at the desired frequency, dictated by the engine speed, is determined through the calculation of signal DFT. This results in a single vector of known phase and magnitude. Clearly, both linearity and superposition principles hold in this method. The Cartesian components of the DFT of the measured signal in real-time and computed over one engine cycle has the following components:

$$X=\Sigma f_j W(\theta_i),\ i=1, \ldots ,m$$

$$Y=\Sigma g_i W(\theta_i),\ i=1, \ldots ,m$$

where $W(\theta_i)$ is the value of the signal, due to unknown imbalances, measured at crank angle $\theta_i$ and index 'm' is such that the sensor is measured for at least one full engine cycle (i.e. two engine revolutions) at a minimal sampling rate of 4× (desirable rate≧8×). Clearly a four-cylinder engine with 60× surpasses this requirement. The parameters $f_i$ and $g_i$ are entered from previously defined table lookups in step I.

Figures 4A, 4B:
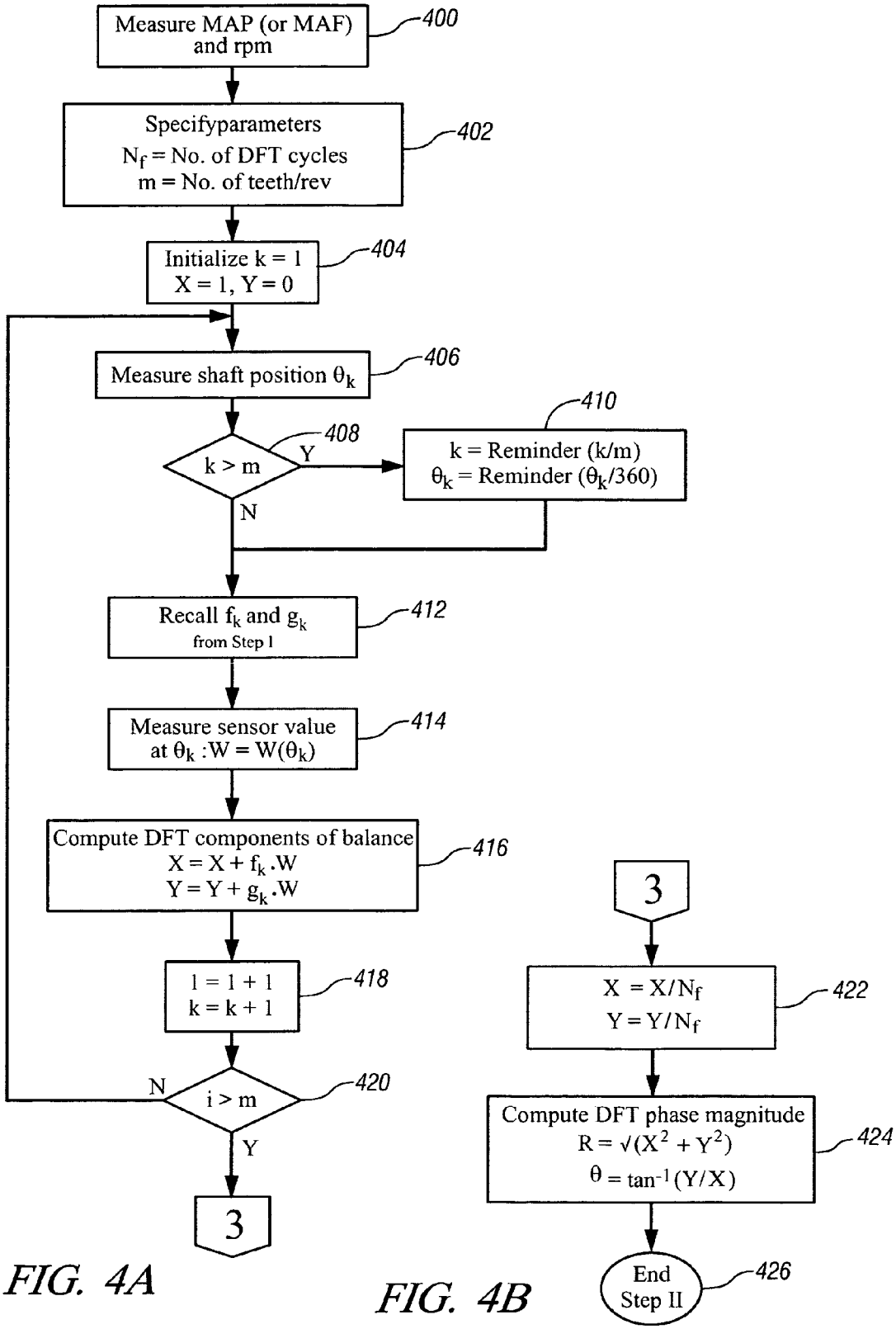
FIGS. 4A–4B is a flow diagram of an algorithm for the real-time detection of fueling imbalances in a four-cylinder engine.

A complete detailed flowchart of the imbalances detection process (step II) for the templates $T_3$ and $T_4$ is attached as FIGS. 4A–4B. For the template $T_2$ which has residues purely at the $2^{nd}$ harmonic, the procedure requires the detection of the magnitude of DFT (A/F) at the $2^{nd}$ harmonic only.

Referring to FIGS. 4A–4B, the detection process begins by measuring manifold pressure (MAP) or intake airflow rate (MAF) and engine speed (rpm) in block 400. Then the number of cycles $N_F$ required for DFT calculation and the number of teeth on the crankshaft encoder (m) are specified, block 402. At block 404, initialization of the index for crank angle (k) and DFT cylinder imbalance components takes place. At every crankshaft sensor tooth k, the crank position ($\theta_k$) is measured (block 406), and when the index exceeds the total number of teeth (block 408), both the index and the teeth angle are adjusted as in block 410. Otherwise, for the current shaft position, the corresponding sine and cosine parameters in block 412 are retrieved from the calibration procedure described above. The oxygen sensor (or torque sensor) output $W(\theta_k)$ at this crank position $\theta_k$ is recorded in block 414.

Now, the data necessary to compute the current engine operating contribution to DFT of the system response is available in the PCM. The Cartesian coordinates of the DFT components of the imbalances are calculated as described above and as shown in block 416. At this point, the counters for the tooth number (k) and accumulative tooth number (1) are incremented, block 418. If the accumulated tooth number (1) in block 420 indicates that DFT calculation has been completed for the required number of cycles $N_f$, the control transfers to block 422 where the DFT components are computed; otherwise computation returns to block 406. With the Cartesian components of DFT in hand, one can easily compute the radial components of DFT as shown in block 424 and exit the detection step in block 426.

III. Correction of Imbalances

Two methods for the correction of imbalances are proposed each with unique features and advantages. The primary method of correction is referred to as the single-axis projection method and is described first.

Method A: The Single-Axis Projection (SAP) Method

Figure 11:
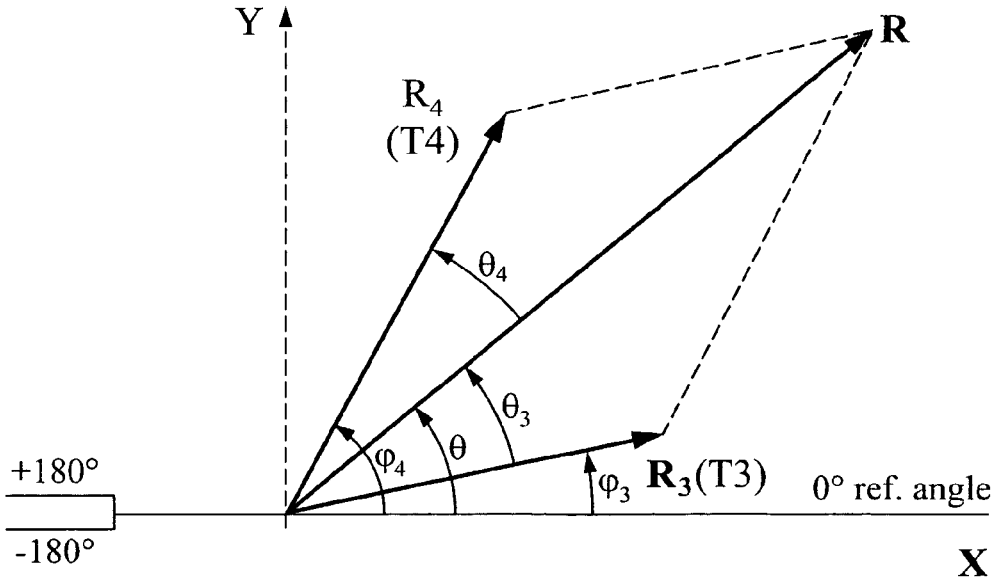
FIG. 11 is a graph illustrating a generic imbalance vector (magnitude R and phase angle, $\theta$) and template $T_3$ and $T_4$ contributions with magnitudes $R_3$ and $R_4$ and phase angles $\phi_3$ and $\phi_4$. The angles between the measured imbalance vector and the individual contributing imbalances vectors $T_3$ and $T_4$ are identified as $\theta_3$ and $\theta_4$, respectively.

The contributions of individual templates are obtained by the decomposition of the DFT vector of the measured signal onto the DFT vectors of individual templates $T_3$ and $T_4$. For the 4-cylinder engine, the basic templates are always at 90° degrees phase difference. That is to say $\phi_4=\phi_3+90°$. The Cartesian components of DFT's are related as follows:

$$X=X_3+X_4$$

$$Y=Y_3+Y_4=X_3.\tan(\phi_3)+X_4.\tan(\phi_4)=c_3.X_3+c_4.X_4$$

where $X_i$ and $Y_i$ are Cartesian components of the DFT of the template $T_i$ contributions (as yet unknown), and, X and Y are the (known) total DFT components of the unknown imbalances computed from the sensor output measurement. FIG. 11 illustrates the imbalance vector (magnitude R and phase angle θ) and template vectors $T_3$ and $T_4$ with magnitudes $R_3$ and $R_4$ and phase angles $\phi_3$ and $\phi_4$. This figure is a schematic illustration of various DFT vectors of interest. The angles between the measured imbalance vector and template vectors of $T_3$ and $T_4$ are identified as $\theta_3$ and $\theta_4$, respectively.

The unknown components $X_3$ and $X_4$ are now calculated from solving the above set of two equations:

$$X_3=(c_4.X-Y)/\Delta,$$

$$X_4=(Y-c_3.X)/\Delta$$

Please note that only a single axis is dealt with at the time (i.e. only $X_i$ or $Y_i$). In occasions when either $C_3$ or $C_4$ assume large values (i.e. either $\phi_3$ or $\phi_4$ approaches 90°), we swap $X_i$ for $Y_i$ in the above equations and proceed.

During the calibration phase, we had determined that the application of a simple template $T_i$ of reference magnitude $d_{i0}$ resulted in DFT component $X_{i0}$ for i=3 and 4. With the principle of linearity holding, one can infer that the unknown contribution $d_i$ of each template $T_i$ in the measured imbalances vector is similarly determined by:

$$d_i=X_i/X_{i0}.d_{i0} \text{ for i=3 and 4}$$

In other words, we have:

$$d_3=d_{30}.(c_4.X-Y)/(\Delta.X_{30})$$

$$d_4=d_{40}.(Y-c_3.X)/(\Delta.X_{40})$$

To restore A/F balance to all cylinders, we apply templates $T_i$ of opposite magnitude $-d_i$. This is achieved by adding appropriate patterns of offsets (related to the template) to average cylinder fuel pulse width in each cylinder. For example to apply −6% in $T_3$ with a pattern [+1, 0, −1, 0], we remove 6% from cylinder 1 fuel, add 6% to cylinder 4, and leave cylinders 2 and 3 fuel unchanged (with the firing sequence 1342).

The above single-shot approach would immediately eliminate the A/F imbalances of the fundamental frequency in a 4-cylinder (or V8 engine with dual exhaust system). Similarly, application of a template $T_2$ with a pattern of [−1, +1, −1, +1] of magnitude $-d_2$ will immediately remove the effect of imbalances at the $2^{nd}$ harmonic.

Figure 5:
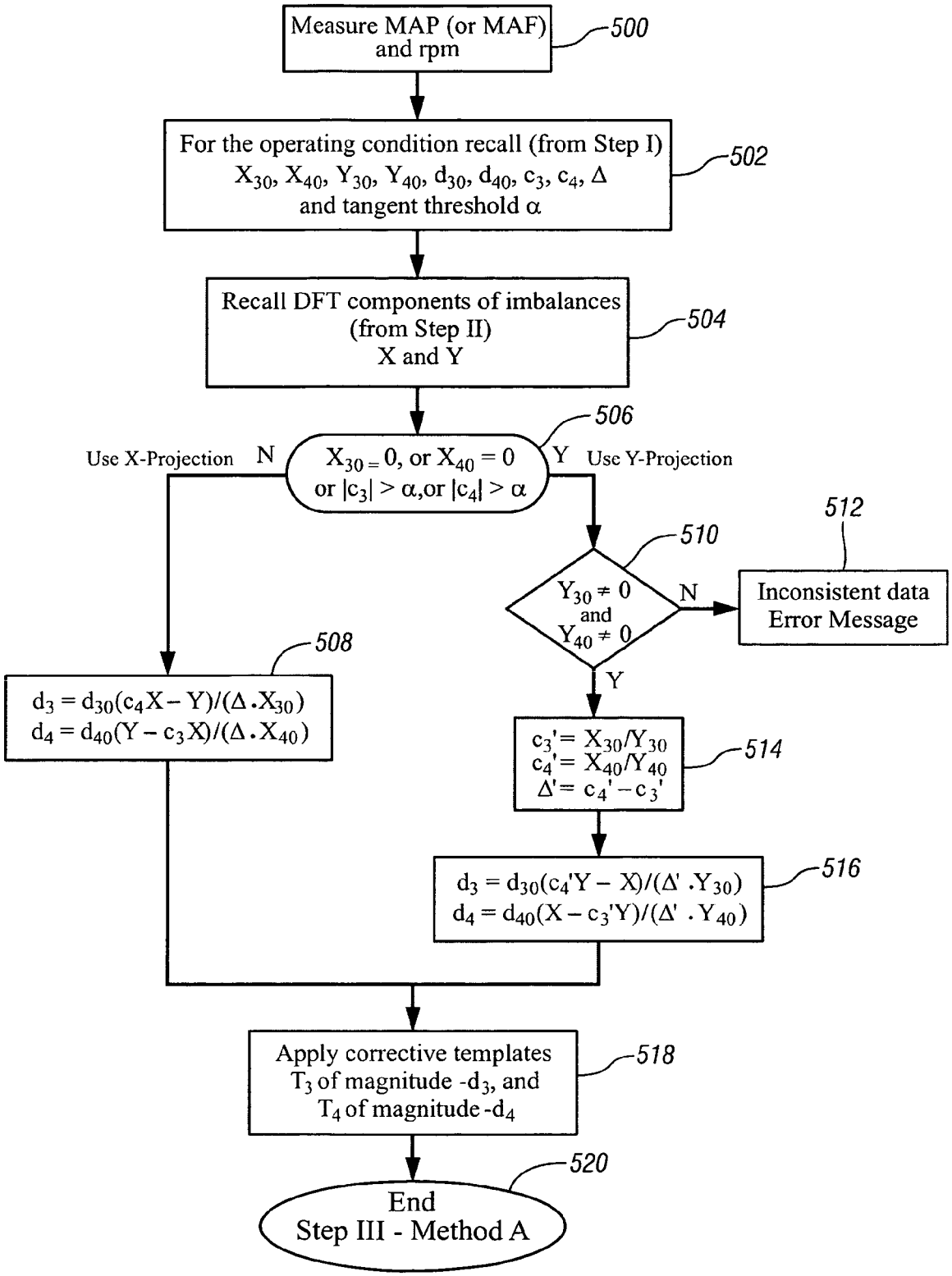
FIG. 5 is a flow diagram of a single-axis method for the real-time correction of first harmonic fueling imbalances for a four-cylinder engine.

FIG. 5 is a flow diagram summarizing the algorithm for performing the correction process by Method A:

1. Measure engine load (MAP) or air flow rate (MAF) and speed rpm as in block 500.

2. Recall Δ, $c_i$, $d_{i0}$, $X_{i0}$ for i=3 and 4 from the calibration step I, and assign a tangent threshold value α (block 502).

3. Recall DFT components of imbalances in Cartesian coordinates (X and Y) from the signal output (step II) as in block 504.

4. Check for conditions in block 506. If the answer is negative, then proceed to block 508 to use the X-axis projection. If the answer is positive, go to block 510 (step 6 below) to use the Y-axis projection.

5. Compute contribution $d_i$ of each template $T_i$ in the total imbalances (block 508) from $$d_3=d_{30}.(c_4.X-Y)/(\Delta.X_{30})$$

$$d_4=d_{40}.(Y-c_3.X)/(\Delta.X_{40})$$

and go to block 518

6. Both $X_{30}$ and $X_{40}$ must clearly be non-zero. Otherwise, the roles of X and Y are properly swapped as in bock 514. With the new set of parameters computed in block 514, proceed to block 516 to calculate the contribution $d_i$ of each template. The control is then transferred to block 518.

7. Apply template $T_i$ of opposite magnitude $-d_i$ to restore A/F balance, block 518.

8. Apply template $T_2$ of opposite magnitude $-d_2=-X_2/X_{20}.d_{20}$ where $X_2$ is the projected magnitude of imbalances at the $2^{nd}$ harmonic due to the reference template $T_2$. The process for the correction of imbalances at block 520 is now complete.

Each of $X_{20}$, $X_{30}$ and $X_{40}$ must clearly be nonzero. Otherwise the roles of $X_{i0}$ and $Y_{i0}$ can be swapped properly (as illustrated in the flow chart of FIG. 5). In this procedure only a single ($X_{i0}$ or $Y_{i0}$) component of DFT of T1 is used and hence the name single-axis projection (SAP).

In some applications, due to imperfections or inherent properties (such as nonlinearity) and variability, it may be necessary to iterate a few times to achieve the final goal. This is particularly true for $O_2$-based A/F control dominated by strong sensor nonlinearity. The following alternative method for the correction of imbalances is suitable where some trigonometric function evaluations (or the use of corresponding tabulated values) are allowed.

Method B: Total Magnitude Method

This is a closed-loop method mostly using the magnitude information. In this technique, we argue that due to severe sensor degradation it is possible that the phase information of the computed DFT may not be sufficiently reliable. Distortions in sensor and/or engine characteristics usually have less impact on signal magnitudes and more on the phase information. To make the method more robust, the magnitude information is employed for evaluation of the level of imbalances. Naturally, any discrepancy in the phase information would require more time and iterations to achieve convergence. The method uses geometry to compute the magnitude and involves some calculations of trigonometric functions in real time.

Polar coordinates are used to determine the contribution of individual templates. Once the vector of measured DFT with magnitude R and phase angle θ is computed, the vector is decomposed onto $T_3$ & $T_4$ templates shown below to determine the contribution of each individual template magnitudes $R_3$ and $R_4$.

Let's define $$\begin{cases}\theta_3=\theta-\varphi_3,\ \rho=\cos(\varphi_4-\varphi_3)\\ \theta_4=\varphi_4-\theta,\ q=\sin(\theta_3)/\sin(\theta_4),\ s=+1\Big/\sqrt{(1+q^2+2\cdot q\cdot\rho}\end{cases}$$

where $\phi_3$ and $\phi_4$ are known values from the calibration step I.

From the vectorial representation of DFT in FIG. 11 below, we have:

$$\begin{cases} R_3 \cdot \sin(\theta_3) = R_4 \cdot \sin(\theta_4) \\ R^2 = R_3 \cdot R_3 + R_4 \cdot R_4 + 2R_3 \cdot R_4 \cdot \rho \end{cases}$$

It can readily be shown that the magnitude of $T_3$ and $T_4$ contributions are $R_3$=Rs for $T_3$ $R_4=R_3.q$ for $T_4$ In the above relation for $R_3$ we adopt the following sign convention:

if $\{\theta \geqq \phi_4$ or $\theta \leqq \phi_4-180)\}$ then $s \rightarrow -s$.

With $R_3$ and $R_4$ calculated we now proceed to compute the weighting factors for each template:

$$d_3=d_{30}.R_3/R_{30}=d_{30}.R.s/R_{30}$$

$$d_4=d_{40}.R_4/R_{40}=d_{40}.R.q.s/R_{40}$$

The required correction is then a combination of templates $T_3$ and $T_4$ of magnitude $-d_3$ and $-d_4$, respectively.

Summary of Method B (Total Magnitude) for Correction of Imbalances

Figure 6:
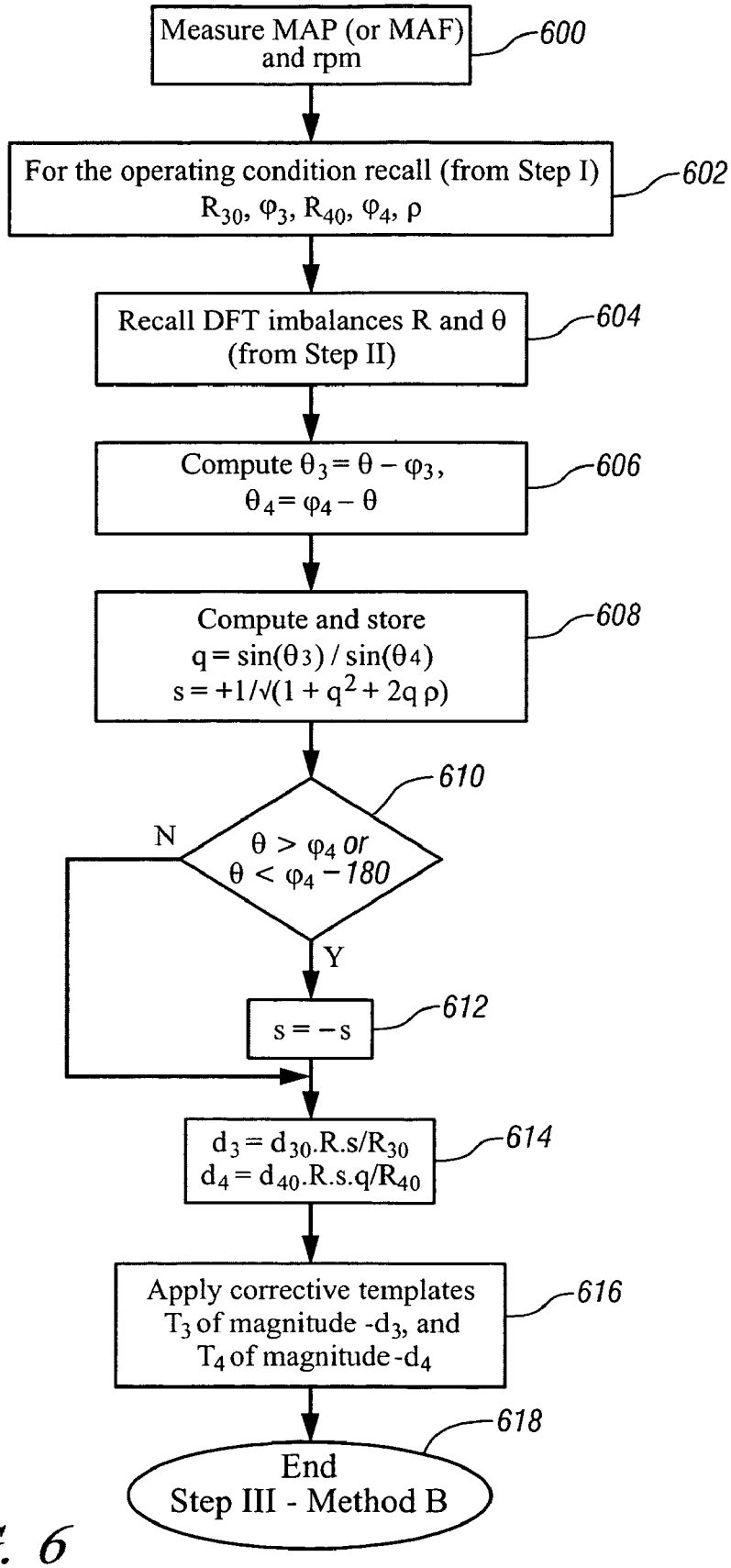
FIG. 6 is a flow diagram of a total magnitude method for the real-time correction of first harmonic fueling imbalances for a four-cylinder engine.

FIG. 6 is a flow diagram summarizing the algorithm for performing the correction process by Method B for first harmonic imbalances (i.e., Templates $T_3$ and $T_4$).

1. Measure engine load (MAP) or airflow rate (MAF) and speed (rpm) as in block 600.

2 For the operating condition recall $\phi_3$, $\phi_4$, $\rho$, $d_{30}$, $d_{40}$, $R_{30}$ and $R_{40}$ from the calibration step I (block 602).

3. Compute the DFT vector (R and $\theta$) of total imbalances from the measured signal from the detection step II at the fundamental frequency for $T_3$ and $T_4$, (block 604).

4. Compute $\theta_3=\theta-\phi_3$, $\theta_4=\phi_4-\theta$ (block 606).

5. Compute and store $q=\sin(\theta_3)/\sin(\theta_4)$ and $s=+1/\sqrt{(1+q^2+2.q.\rho)}$, block 608.

6. Check for conditions in query box 610. If true (yes), change the sign of parameter "s," as in block 612.

7. Calculate $T_3$ contribution from $d_3=d_{30}.R_3/R_{30}=d_{30}.R.s/R_{30}$. Sign convention for 's' applies. Calculate $T_4$ contribution from $d_4=d_{40}.R_4/R_{40}=d_{40}.R.q.s/R_{40}$. Sign convention for 's' applies.(block 614).

8. To correct the imbalances apply templates $T_3$ and $T_4$ of magnitude as $-d_3$ and $-d_4$, respectively, as in block 616. The correction process for first harmonic imbalances ends at process block 618.

Figure 7:
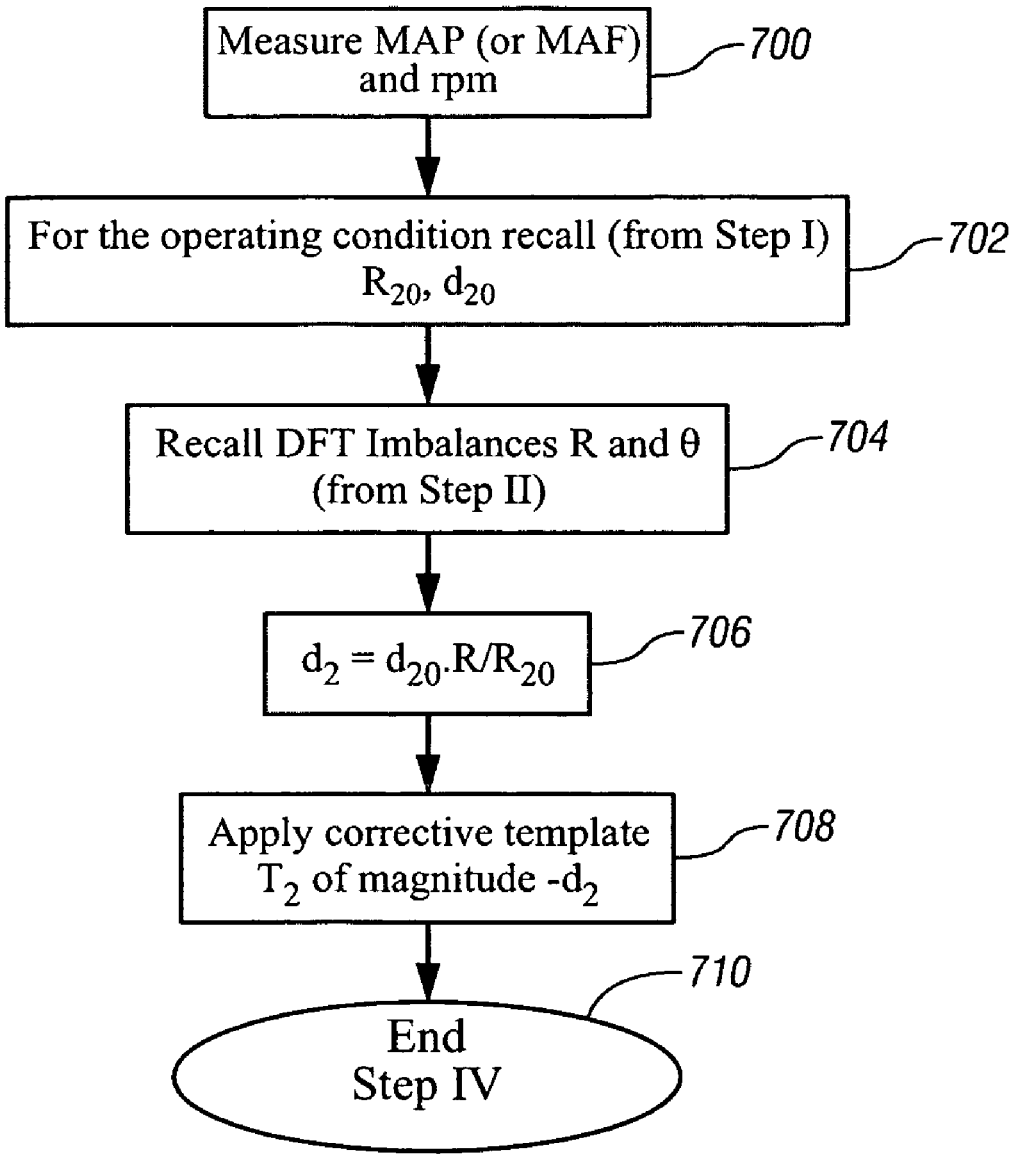
FIG. 7 is a flow diagram for real-time correction of second harmonic fueling imbalances in a four cylinder engine.
Figure 8A:
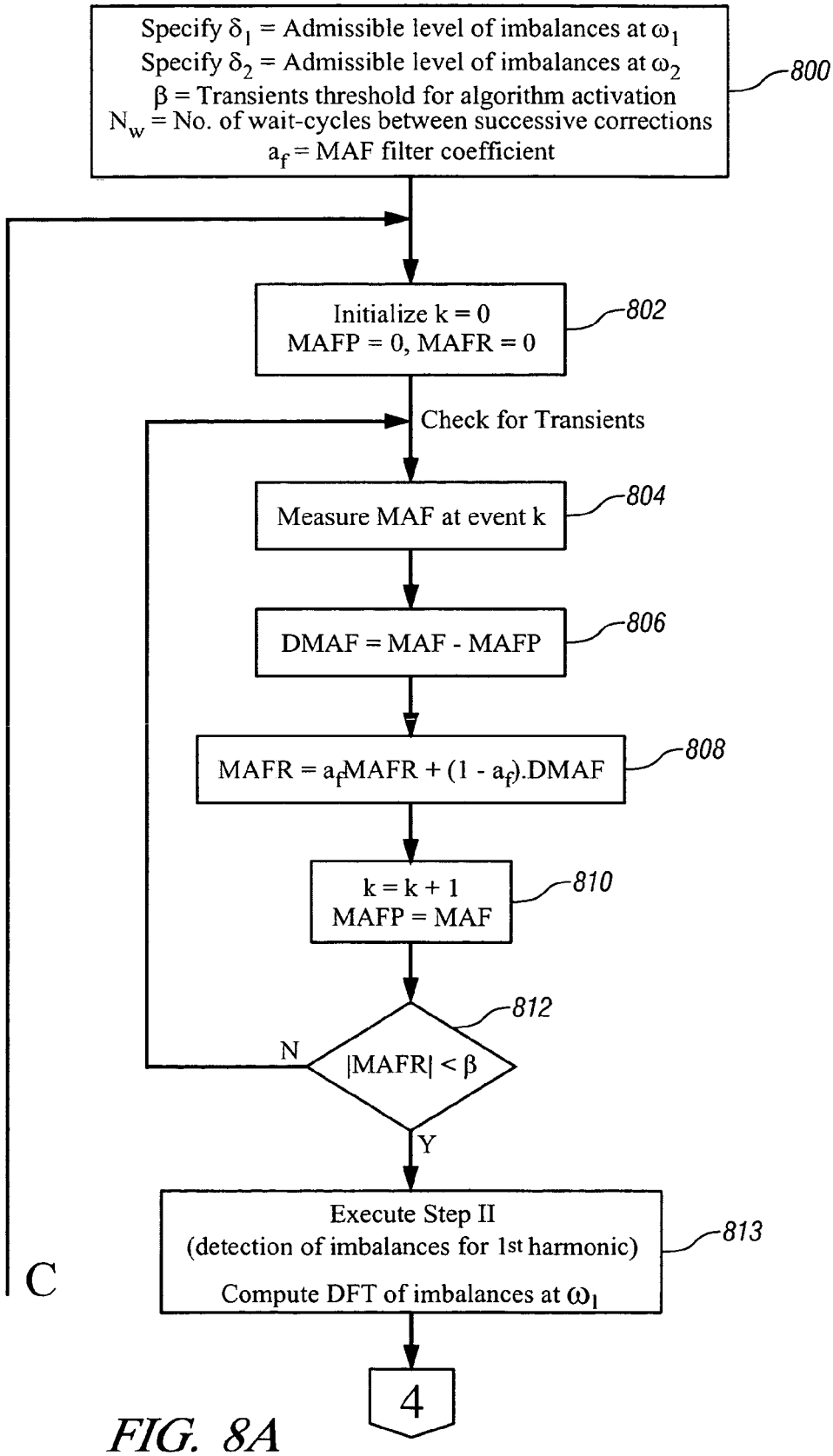
FIGS. 8A–8D present an algorithm flow chart for an overall individual cylinder fuel control incorporating the above-mentioned previous steps.
Figure 8B:
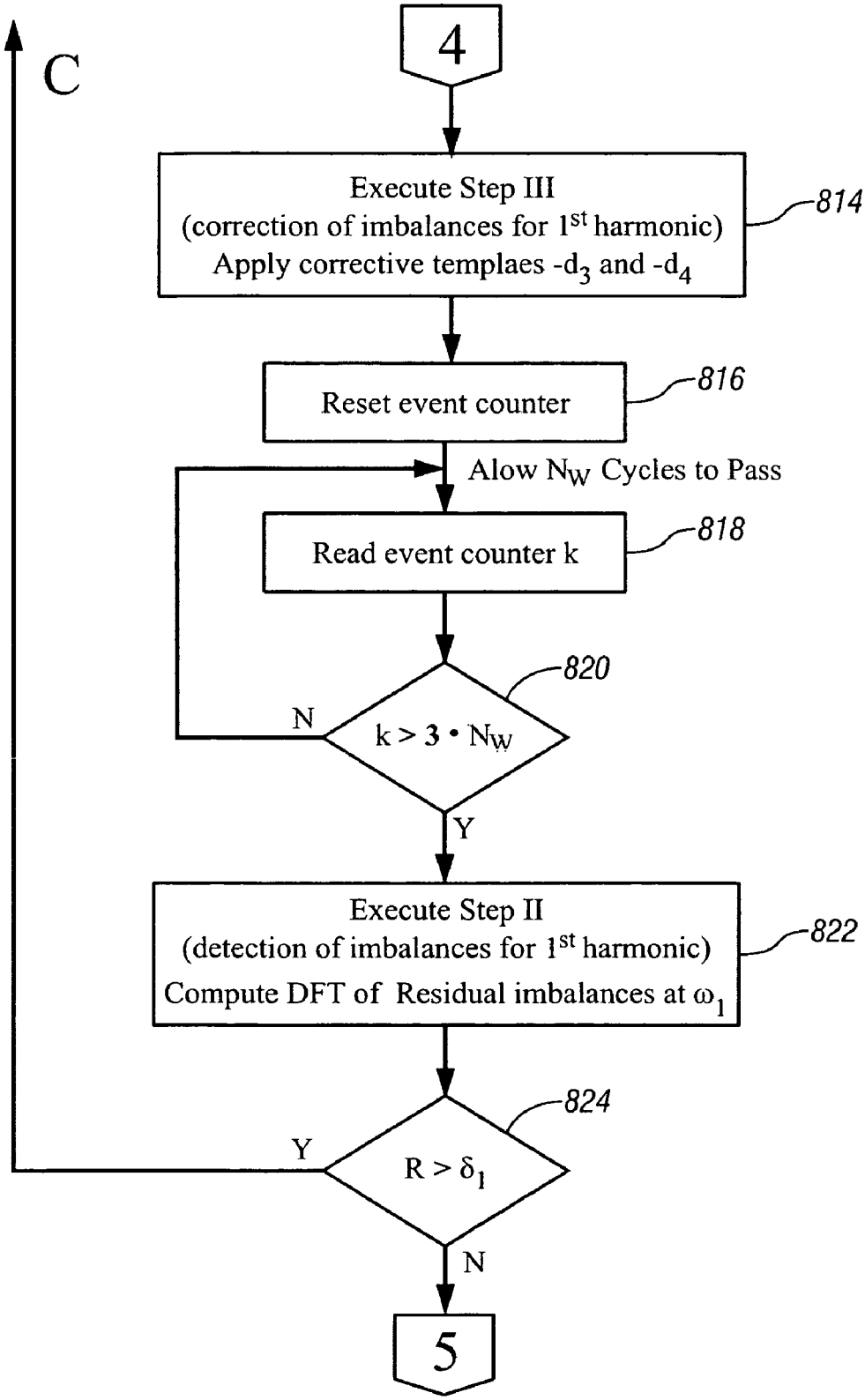
Figure 8C:
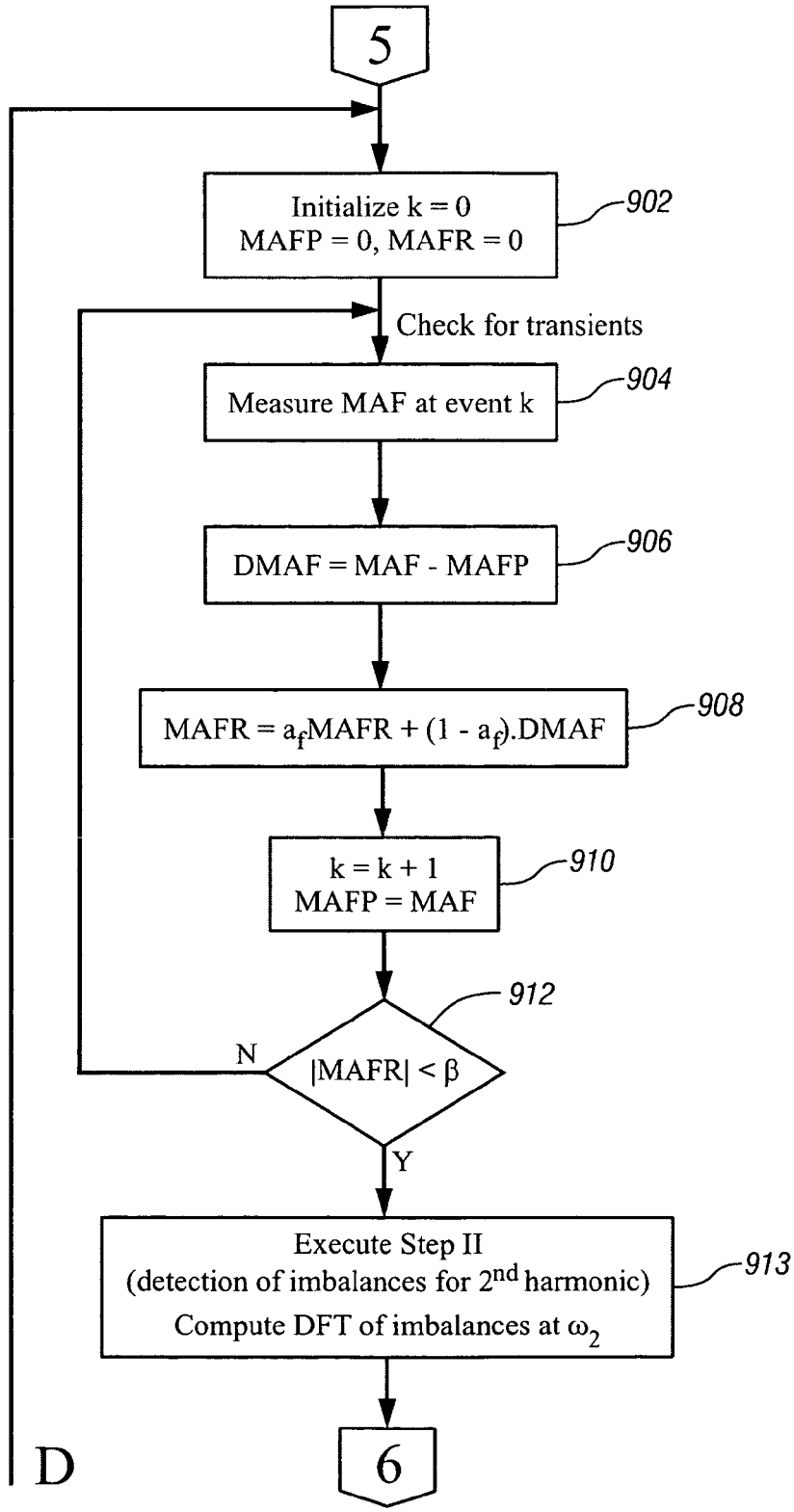
Figure 8D:
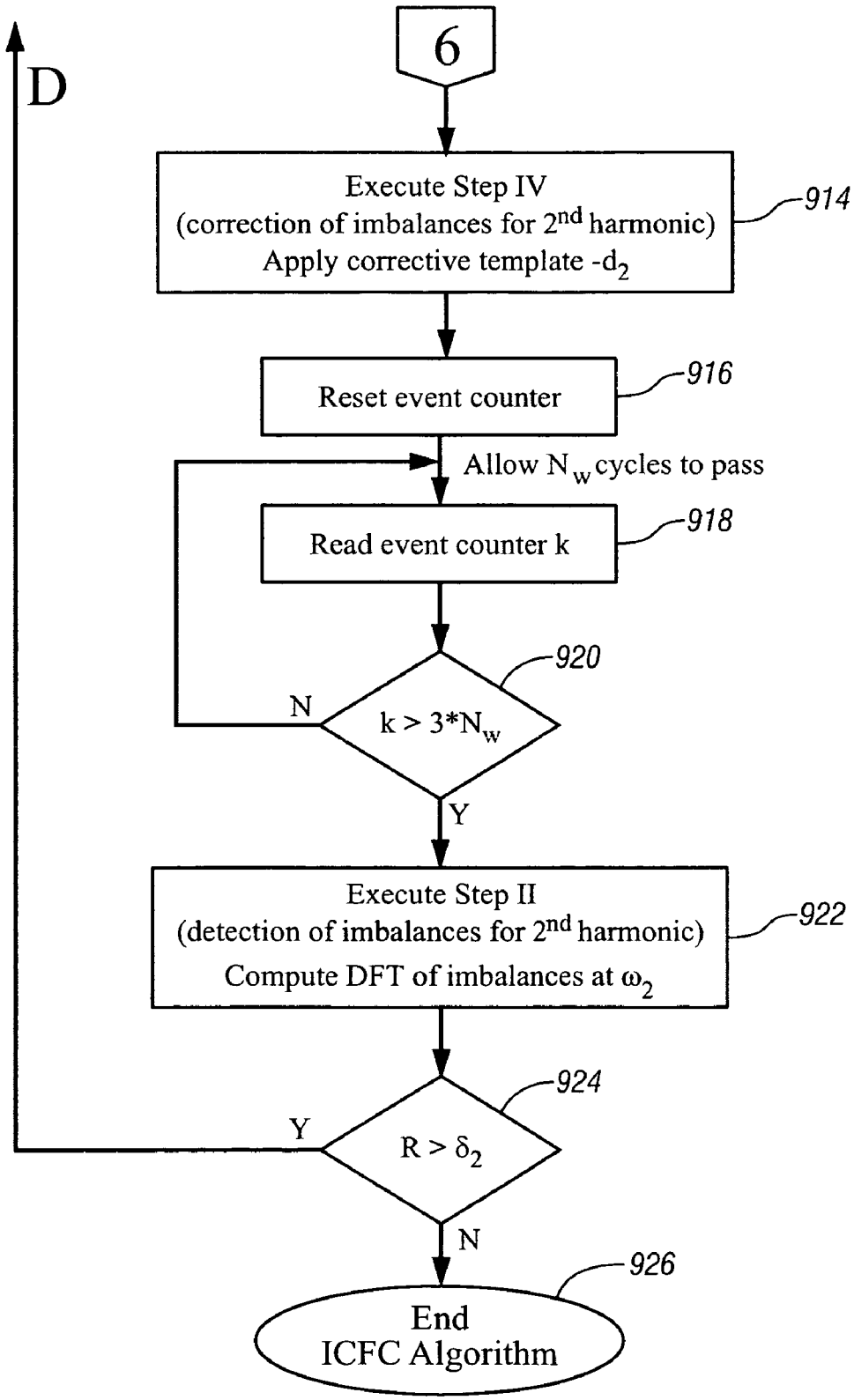

FIG. 7 is a flow diagram summarizing the algorithm for performing the correction process by Method B for second harmonic imbalances.

1. Measure engine load (MAP) or airflow rate (MAF) and speed (rpm) as in block 700.

2. For the operating condition, recall $\rho$, $d_{20}$, $R_{20}$, from the calibration step I (block 702).

3. Compute the DFT vector (R and $\theta$) of total imbalances from the measured signal from the detection step II at $2^{nd}$ harmonic for $T_2$ (block 704).

4. Calculate $T_2$ contribution from $d_2=d_{20}.R_2/R_{20}$, block 706.

5. To correct the imbalance apply template $T_2$ of magnitude $-d_2$ as in block 708. The correction process for the second harmonic imbalance ends at process block 710.

As before, a few iterations of the methods illustrated in FIGS. 6 and 7 may be needed to achieve the corrections by the total magnitude method. This is particularly true when an $O_2$ sensor is used to detect and correct the imbalances at the stoichiometric A/F.

The Control Algorithm

The above techniques provide the basis for a control algorithm for the real-time balancing of individual cylinder A/F or torque maldistribution. Cylinder imbalances rarely require fast correction and therefore a slow control loop of low bandwidth is sufficient. Inherent in the algorithm is its robustness, simplicity and ease of implementation. The algorithm may be used for cylinder A/F maldistribution calibration on a new engine family (off-line application), for its diagnostic value (imbalances including cylinder misfire detection) and also real-time control and attenuation of cylinder A/F maldistributions or torque imbalances.

For an engine speed N [rpm], one full cycle takes $T_o$=120/N [s] (four-stroke engine). $T_o$ is the time between successive injections in the same cylinder. The fundamental frequency of imbalances is also given by the frequency $\omega=1/T_o$ [Hz]. The sensor is sampled at a rate $T_s$ where $T_s^o<T_o/n$ with n>1 to avoid aliasing though an event-based sampling is preferred with synchronization with the crankshaft encoder (e.g. 24× in V8 engine). Detection of imbalances at the frequency $\omega_o$ also requires a sensor with the same minimum bandwidth (usually 2–5 times wider). The bandwidth requirement also imposes constraints on the upper limit on engine speed at which the imbalances can effectively be detected.

In the calibration step I, the necessary information at any operating condition was developed. This information is either tabulated or preferably curve-fitted to reduce the data management. In the next section on the presentation of experimental results two analytic functions for the phase and magnitude ($R_{30}$, $\theta_{30}$) information of the basic template $T_3$ are described.

An overall procedure for individual cylinder fuel control is outlined below with reference to the algorithm flow charts of FIGS. 8A–8D. In these flow charts, process step corrections for first harmonic imbalances are shown in blocks 802–824 and a like process for second harmonic corrections is shown through blocks 902–924. For purposes of brevity the steps are described once.

1. Establish the DFT thresholds $\delta_1$ and $\delta_2$ for the acceptable levels of imbalances at $\omega_1$ and $\omega_2$, respectively. The threshold is a function of engine operating conditions i.e. $\delta$=f(rpm, MAP, MAF, MAT, Mode, . . . ). Also establish a transient threshold $\beta$ for algorithm activation and a filter constant $a_f$ for MAF filtering (block 800).

2. Specify the number of wait-cycles ($N_w$) between correction and any subsequent detection to allow transient effects settled. This introduces a dead-time into the algorithm and has two functions: to reduce the impact of A/F transients and to allow the effect of fuel changes in cylinders to reach the sensor location before any additional corrections are meaningfully attempted (block 800). The wait-time is directly related to the engine and sensor system transportation delays.

3. Initialize k and AAF and MAP variables in block 802 for first harmonic imbalances and block 902 for second harmonic imbalances.

4. Measure MAF at event k (blocks 804, 904).

5. Compute the rate of change of MAF (called DMAF), blocks 806, 906.

6. Filter DMAF with a filter coefficient $a_f$ (called MAFR), blocks 808, 908.

7. Increment event k and update old MAF in blocks 810, 910.

8. Check the rate of change of MAF (or MAP) to be below the threshold value $\beta$ before enabling the algorithm, blocks 812, 912. Given the high speed of algorithm execution, the algorithm may be enabled even under mild transient conditions so that imbalances are eliminated on the fly.

9. Execute Step II for detection of imbalances for first harmonics, block 813, and second harmonics, block 913.

10. Execute the procedure for the correction of imbalances (Step III) by computing template $T_2$, $T_3$ and $T_4$ contributions $d_2$, $d_3$ and $d_4$, respectively. Apply templates $T_i$ of opposite magnitude ($-d_i$) simultaneously to counteract the measured imbalances. (blocks 814, 914).

11. Count events (blocks 818, 918) and wait for $N_w$ engine cycles to pass (blocks 820, 920). In actual implementation, a wait-cycle three times bigger produced good results.

12. Measure imbalances again (blocks 822, 922) and verify that imbalances have indeed been removed. For this purpose, execute the procedure for the detection of imbalances (Step II) to determine any possible residual imbalances. Compute the magnitude of imbalances R (blocks 824, 924).

13. In blocks 824, 924, if $R<\delta_i$ take no further action (negligible imbalances). If the magnitude of DFT after initial correction is still above the threshold, $\delta_i$, then start a new iteration (steps 3 to 12). This concludes (block 926) the process for the individual cylinder control algorithm in a four-cylinder engine.

In all applications, A/F imbalances were detected and corrected in less than one second. This enables one to activate individual cylinder control algorithms even under mild transient operations. The method is robust to system disturbances such as sudden EGR valve openings, load applications and exhaust back-pressure changes.

The above description illustrated the use of exhaust oxygen sensors for A/F imbalances detection and correction through fuel injector biasing (i.e., fuel control). The invention is also applicable for air control if variable-valve actuation technology is used. Moreover, in conjunction with a crankshaft torque sensor, the disclosed techniques can also be used for the elimination of torque imbalances (i.e., torque control).

FIG. 1 illustrates a practice of the invention with templates T2, T3, and T4 in which each template displays zero average values over one engine cycle. It will be apparent to one skilled in engine control methods that that other choices for the individual cylinder variations patterns or templates can be made (such as patterns with an imbalance in a single cylinder) without changing this method of detecting and correcting cylinder imbalances in any new way. Thus, while the invention has been described in terms of specific examples, it is apparent that other embodiments could readily be adapted by one skilled in the art and the invention is limited only by the scope of the following claims.

The invention claimed is:

1. A method of detecting and correcting air, fuel, or spark imbalances among the individual cylinders of a four-cylinder group of a 4-cylinder or V8 engine in a vehicle comprising a sensor for detecting the ratio of air to fuel (A/F) supplied to the engine or for detecting torque generated by the engine, and an engine control module comprising a computer, the functions of said module including timing and duration of delivery of air or fuel, or ignition timing to the cylinders of the engine, said method being executed by said computer and comprising:

collecting a time sequential series of signals from the sensor over at least one engine cycle at the current engine speed and load;

converting the series of signals by discrete Fourier transform to a vector of A/F or torque imbalances, in the frequency domain having only two discrete speed-dependent frequencies, related to the air, fuel or spark delivery imbalances, the vector having a magnitude;

retrieving three mutually orthogonal imbalance reference vectors of known magnitude corresponding to discrete Fourier transforms of three nominal imbalance patterns obtained during engine calibration and stored in the memory of the computer for the current engine speed and load;

projecting the measured imbalance vector onto the three retrieved orthogonal imbalance reference vectors;

determining unique contributions in the imbalance vector attributable to the three nominal imbalance reference vectors; and applying, in each cylinder of the engine, air, fuel or spark corrective quantities of opposite magnitude to each of the contributions so determined to correct for the measured imbalances.

2. A method as recited in claim 1 for detecting air, fuel or spark imbalances in which the vector of A/F or torque imbalances has a magnitude and phase angle; the three imbalance reference vectors have known magnitudes and phase angles; and the measured imbalances are corrected by applying in each cylinder of the engine, air, fuel, or spark corrective quantities of opposite magnitude and phase angle for each of the contributions determined attributable to the reference vectors.

3. A method as recited in claim 1 for detection and correction of A/F imbalances among the individual cylinders of a four-cylinder group of a 4-cylinder or V8 engine in a vehicle comprising a wide range A/F sensor or an $O_2$ sensor, and an engine control module comprising a computer, the functions of said module including the amount of fuel and air supplied to the individual cylinders of the engine, said method being executed by said computer and comprising:

collecting a time sequential series of A/F signals from the sensor over at least one engine cycle at the current engine speed and load;

converting the series of signals by discrete Fourier transform to a vector of A/F imbalances, in the frequency domain having only two discrete speed-dependent frequencies, related to fuel or air delivery imbalances in the individual cylinders, the vector having a magnitude;

retrieving three mutually orthogonal imbalance reference vectors of known magnitude corresponding to discrete Fourier transforms of three nominal A/F imbalance patterns obtained during engine calibration and stored in the memory of the computer for the current engine speed and load;

projecting the measured A/F imbalance vector onto the three retrieved orthogonal A/F imbalance reference vectors;

determining unique contributions in the A/F imbalance vector attributable to the three retrieved A/F imbalance reference vectors; and applying, in each cylinder of the engine, air or fuel corrective quantities of opposite magnitude to each of the contributions so determined to correct for the measured A/F imbalances.

4. A method as recited in claim 3 in which the vector of A/F imbalances has a magnitude and phase angle; the three imbalance reference vectors have known magnitudes and phase angles; and the measured imbalances are corrected by applying in each cylinder of the engine, air or fuel corrective quantities of opposite magnitude and phase angle for each of the contributions determined attributable to the reference vectors.

5. A method as recited in claim 3 in which the fuel delivery imbalances are corrected through control of duration or mass of individual cylinder fuel injection.

6. A method as recited in claim 4 in which the fuel delivery imbalances are corrected through control of duration or mass of individual cylinder fuel injection.

7. A method as recited in claim 3 in which air delivery imbalances are corrected through control of individual intake valve lift, duration or phasing.

8. A method as recited in claim 4 in which air delivery imbalances are corrected through control of individual intake valve lift, duration or phasing.

9. A method as recited in claim 1 for detection and correction of engine torque imbalances among the individual cylinders of a four-cylinder group of a 4-cylinder or V8 engine in a vehicle comprising an engine torque sensor, and an engine control module comprising a computer, the functions of said module including delivery of air and ignition timing to individual cylinders of the engine, said method being executed by said computer and comprising:

collecting a time sequential series of torque signals from the sensor over at least one engine cycle at the current engine speed and load;

converting the series of signals by discrete Fourier transform to a vector of torque imbalances, in the frequency domain having only two discrete speed-dependent frequencies, related to the air delivery or spark delivery imbalances in individual cylinders, the vector having a magnitude;

retrieving three mutually orthogonal torque imbalance reference vectors of known magnitude corresponding to discrete Fourier transforms of three nominal torque imbalance patterns obtained during engine calibration and stored in the memory of the computer for the current engine speed and load;

projecting the measured torque imbalance vector onto the three retrieved orthogonal torque imbalance reference vectors;

determining unique contributions in the torque imbalance vector attributable to the three retrieved torque imbalance reference vectors; and applying, in each cylinder of the engine, air or spark corrective deliveries of opposite magnitude to each of the contributions so determined to correct for the measured torque imbalances.

10. A method as recited in claim 9 for detection and correction of torque imbalances in which the vector of torque imbalances has a magnitude and phase angle; the three imbalance reference vectors have known magnitudes and phase angles; and the measured imbalances are corrected by applying, in each cylinder of the engine, air or spark corrective deliveries of opposite magnitude and phase to each of the contributions so determined to correct for the measured torque imbalances.

11. A method as recited in claim 9 in which the torque imbalances are corrected through control of individual intake valve lift, duration or phasing.

12. A method as recited in claim 10 in which the torque imbalances are corrected through control of individual intake valve lift, duration or phasing.

13. A method as recited in claim 9 in which the torque imbalances are corrected through adjustment of spark timing delivery.

14. A method as recited in claim 10 in which the torque imbalances are corrected through adjustment of spark timing delivery.

15. A method as recited in claim 3 in which the three imbalance reference vectors comprise a first vector representing fuel imbalances to the four cylinders, synchronous with the firing order in the cylinders, in a first pattern: a rich A/F of size $b_2$, a lean A/F of size $b_2$, a rich A/F of size $b_2$ and a lean A/F of size $b_2$; a second vector representing fuel imbalances in a second pattern: a lean A/F of size $b_3$, stoichiometric A/F, a rich A/F of size $b_3$, and stoichiometric A/F; and a third vector representing fuel imbalances in a third pattern: a stoichiometric A/F, a lean A/F of size $b_4$, stoichiometric A/F, and a rich A/F of size $b_4$; and the measured A/F imbalance vector is projected onto said three A/F imbalance reference vectors.

16. A method as recited in claim 9 in which the three imbalance reference vectors comprise a first vector representing torque imbalances in the four cylinders, synchronous with the firing order in the cylinders, in a first pattern: a below-average torque of size $b_2$, an above-average torque of size $b_2$, a below average torque of size $b_2$ and an above-average torque of size $b_2$; a second vector representing torque imbalances in a second pattern: an above-average torque of size $b_3$, an average value of torque, a below-average torque of size $b_3$, and an average value of torque; and a third vector representing torque imbalances in a third pattern: an average torque, an above-average torque of size $b_4$, an average torque, and a below-average torque of size $b_4$; and the measured torque imbalance vector is projected onto said three torque imbalance reference vectors.

17. A method as recited in claim 1 in which the three mutually orthogonal reference vectors are determined at selected representative operational speeds and loads in a four cylinder engine in which each cylinder is initially operated at a balanced reference A/F and then successive variation patterns in A/F are imposed by operation of fuel injectors or air intake valves on the individual cylinders of the engine by a method comprising:

applying a first pattern of fuel imbalances to said cylinders, said first pattern producing respectively a rich A/F of size $b_2$, a lean A/F of size $b_2$, a rich A/F of size $b_2$ and a lean A/F of size $b_2$ in said cylinders and obtaining a first time sequential series of signals from a said A/F sensor or $O_2$ sensor related to said imbalances over at least one engine cycle;

converting said first series of signals by discrete Fourier transform to a first reference vector of fuel imbalances, in the frequency domain, related to said first pattern of fuel delivery imbalances at the current engine speed and load, said first reference vector having a first magnitude or both a first magnitude and phase angle;

applying a second pattern of fuel imbalances to said cylinders, said second pattern producing respectively a lean A/F of size $b_3$, stoichiometric A/F, a rich A/F of size $b_3$, and stoichiometric A/F in said cylinders and obtaining a second time sequential series of signals from a said A/F sensor or $O_2$ sensor related to said imbalances over at least one engine cycle;

converting said second series of signals by discrete Fourier transform to a second reference vector of fuel imbalances, in the frequency domain, related to said second pattern of fuel delivery imbalances at the current engine speed and load, said second reference vector having a second magnitude or both a second magnitude and phase angle;

applying a third pattern of fuel imbalances to said cylinders, said third pattern producing respectively a stoichiometric A/F, a lean A/F of size $b_4$, stoichiometric A/F, and a rich A/F of size $b_4$ in said cylinders and obtaining a third time sequential series of signals from a said A/F sensor or $O_2$ sensor related to said imbalances over at least one engine cycle; and converting said third series of signals by discrete Fourier transform to a third reference vector of fuel imbalances, in the frequency domain, related to said third pattern of fuel delivery imbalances at the current engine speed and load, said third reference vector having a third magnitude or both a third magnitude and phase angle.

18. A method as recited in claim 1 in which the three mutually orthogonal reference vectors are determined at selected representative operational speeds and loads in a four cylinder engine in which each cylinder is initially operated at a balanced reference torque level and then successive variation patterns in torque level are imposed by operation of fuel, air, or spark delivery on the individual cylinders of the engine by a method comprising:

applying a first pattern of air, fuel or spark delivery imbalances to said cylinders, said first pattern producing respectively a below-average torque of size $b_2$, an above-average torque of size $b_2$, a below-average torque of size $b_2$, and an above-average torque of size $b_2$ in said cylinders, synchronous with the firing order in the cylinders, and obtaining a first time sequential series of signals from a said torque sensor related to said imbalances over at least one engine cycle;

converting said first series of signals by discrete Fourier transform to a first reference vector of air, fuel or spark delivery imbalances, in the frequency domain, related to said first pattern of air, fuel or spark delivery imbalances at the current engine speed and load, said first reference vector having a first magnitude or both a first magnitude and phase angle;

applying a second pattern of air, fuel or spark imbalances to said cylinders, said second pattern producing respectively an above-average torque of size $b_3$, an average torque, a below-average torque of size $b_3$, and an average torque in said cylinders, synchronous with the firing order in the cylinders, and obtaining a second time sequential series of signals from a said torque sensor related to said imbalances over at least one engine cycle;

converting said second series of signals by discrete Fourier transform to a second reference vector of air, fuel or spark delivery imbalances, in the frequency domain, related to said second pattern of air, fuel and spark delivery imbalances at the current engine speed and load, said second reference vector having a second magnitude or both a second magnitude and phase angle;

applying a third pattern of air, fuel or spark imbalances to said cylinders, said third pattern producing respectively, an average torque, an above-average torque of size $b_4$, an average value of torque, and a below-average torque of size $b_4$ in said cylinders, synchronous with the firing order in the cylinders, and obtaining a third time sequential series of signals from a said torque sensor related to said imbalances over at least one engine cycle; and converting said third series of signals by discrete Fourier transform to a third reference vector of air, fuel or spark delivery imbalances, in the frequency domain, related to said third pattern of air, fuel and spark delivery imbalances at the current engine speed and load, said third reference vector having a third magnitude or both a third magnitude and phase angle.

19. A method of detecting and correcting air or fuel imbalances among the individual cylinders of a four-cylinder group of a 4-cylinder or V8 engine in a vehicle comprising a sensor for detecting the ratio of air to fuel (A/F) supplied to the engine, and an engine control module comprising a computer, the functions of said module including timing and duration of delivery of air and fuel to the cylinders of the engine, said method being executed by said computer and comprising:

collecting a time sequential series of signals from the sensor over at least one engine cycle at the current engine speed and load;

converting the series of signals by discrete Fourier transform to a vector of A/F imbalances, in the frequency domain having only two discrete speed-dependent frequencies, related to the air or fuel delivery imbalances, the vector having a magnitude;

retrieving three mutually orthogonal A/F imbalance reference vectors of known magnitude corresponding to discrete Fourier transforms of three nominal A/F imbalance patterns obtained during engine calibration and stored in the memory of the computer for the current engine speed and load, the three imbalance reference vectors comprising a first vector representing fuel imbalances to the four cylinders in a first pattern: a rich A/F of size $b_2$, a lean A/F of size $b_2$, a rich A/F of size $b_2$ and a lean A/F of size $b_2$; a second vector representing fuel imbalances in a second pattern: a lean A/F of size $b_3$, stoichiometric A/F, a rich A/F of size $b_3$, and stoichiometric A/F; and a third vector representing fuel imbalances in a third pattern: a stoichiometric A/F, a lean A/F of size $b_4$, stoichiometric A/F, and a rich A/F of size $b_4$, each of the first, second, and third patterns being synchronous with the firing order in the cylinders;

projecting the measured A/F imbalance vector onto the three retrieved orthogonal A/F imbalance reference vectors;

determining unique contributions in the A/F imbalance vector attributable to the three retrieved A/F imbalance reference vectors; and applying, in each cylinder of the engine, air or fuel corrective quantities of opposite magnitude to each of the contributions so determined to correct for the measured A/F imbalances.

20. A method as recited in claim 19 for detecting air or fuel imbalances in which the vector of A/F imbalances has a magnitude and phase angle; the three A/F imbalance reference vectors have known magnitudes and phase angles; and the measured A/F imbalances are corrected by applying in each cylinder of the engine, air or fuel corrective delivery commands of opposite magnitude and phase angle for each of the contributions determined attributable to the reference vectors.

21. A method of detecting and correcting air, fuel, or spark imbalances among the individual cylinders of a four-cylinder group of a 4-cylinder or V8 engine in a vehicle comprising a sensor for detecting torque generated by the engine, and an engine control module comprising a computer, the functions of said module including timing and duration of delivery of air or fuel, or ignition timing to the cylinders of the engine, said method being executed by said computer and comprising:

collecting a time sequential series of torque signals from the torque sensor over at least one engine cycle at the current engine speed and load;

converting the series of torque signals by discrete Fourier transform to a vector of torque imbalances, in the frequency domain having only two discrete speed-dependent frequencies, related to the air, fuel or spark delivery imbalances, the torque vector having a magnitude;

retrieving three mutually orthogonal torque imbalance reference vectors of known magnitude corresponding to discrete Fourier transforms of three nominal torque imbalance patterns obtained during engine calibration and stored in the memory of the computer for the current engine speed and load, the three imbalance reference vectors comprise a first vector representing torque imbalances in the four cylinders in a first pattern: a below-average torque of size $b_2$, an above-average torque of size $b_2$, a below average torque of size $b_2$ and an above-average torque of size $b_2$; a second vector representing torque imbalances in a second pattern: an above-average torque of size $b_3$, an average value of torque, a below-average torque of size $b_3$, and an average value of torque; and a third vector representing torque imbalances in a third pattern: an average torque, an above-average torque of size $b_4$, an average torque, and a below-average torque of size $b_4$, each of the first, second, and third patterns being synchronous with the firing order of the cylinders;

projecting the measured torque imbalance vector onto the three retrieved orthogonal torque imbalance reference vectors;

determining unique contributions in the torque imbalance vector attributable to the three retrieved torque imbalance reference vectors; and applying, in each cylinder of the engine, corrective air intake valve lift, duration or phasing, corrective fuel injection mass or duration, or corrective spark ignition timing quantities of opposite magnitude to each of the contributions so determined to correct for the measured torque imbalances.

22. A method as recited in claim 21 for detecting air, fuel or spark imbalances in which the vector of torque imbalances has a magnitude and phase angle; the three torque imbalance reference vectors have known magnitudes and phase angles; and the measured torque imbalances are corrected by applying in each cylinder of the engine, corrective air intake valve lift, duration or phasing, corrective fuel injection mass or injection duration, or corrective spark ignition timing quantities of opposite magnitude and phase angle for each of the contributions determined attributable to the reference vectors.

* * * * *